US009632473B2

(12) United States Patent
Kobayashi et al.

(10) Patent No.: US 9,632,473 B2
(45) Date of Patent: Apr. 25, 2017

(54) IMAGE FORMING APPARATUS

(71) Applicant: FUJI XEROX CO., LTD., Tokyo (JP)

(72) Inventors: Akihiro Kobayashi, Kanagawa (JP); Osamu Iida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/873,699

(22) Filed: Oct. 2, 2015

(65) Prior Publication Data

US 2016/0259291 A1 Sep. 8, 2016

(30) Foreign Application Priority Data

Mar. 3, 2015 (JP) ..... 2015-040952

(51) Int. Cl.

| | |
|---|---|
| ***G03G 15/00*** | (2006.01) |
| ***G03G 15/16*** | (2006.01) |
| ***G03G 21/18*** | (2006.01) |
| *G03G 15/01* | (2006.01) |

(52) U.S. Cl.

CPC ..... *G03G 15/757* (2013.01); *G03G 15/0136* (2013.01); *G03G 15/1665* (2013.01); *G03G 21/1821* (2013.01); *G03G 15/0178* (2013.01); *G03G 15/5008* (2013.01); *G03G 2215/0119* (2013.01); *G03G 2221/1657* (2013.01)

(58) Field of Classification Search

CPC ..... G03G 15/50
USPC ..... 399/167
See application file for complete search history.

(56) References Cited

U.S. PATENT DOCUMENTS 9,002,234 B2 * 4/2015 Shirayanagi ..... G03G 21/1814 399/111

FOREIGN PATENT DOCUMENTS

| | | | | |
|---|---|---|---|---|
| JP | 2003-287934 | * | 3/2004 | ..... G03G 15/16 |
| JP | 2004-078212 | * | 3/2004 | ..... G03G 15/16 |
| JP | 2004-078212 A | | 3/2004 | |
| JP | 2006-113283 | * | 10/2004 | ..... G03G 15/16 |
| JP | 2006-113283 | * | 4/2006 | ..... G03G 15/16 |
| JP | 2006-113283 A | | 4/2006 | |

* cited by examiner

*Primary Examiner* — Clayton E Laballe
*Assistant Examiner* — Kevin Butler
(74) *Attorney, Agent, or Firm* — Oliff PLC

(57) ABSTRACT

An image forming apparatus includes an image carrier, a drive mechanism, a rotating member, an urging member, and a retracting system. The retracting system includes first and second retracting mechanisms. The first retracting mechanism includes a first gap-maintaining member that maintains a gap between the image carrier and the rotating member, and cancels the retracted state at one end in an axial direction by moving the first gap-maintaining member and cancelling a gap-maintaining state established by the first gap-maintaining member. The second retracting mechanism includes a second gap-maintaining member that maintains a gap between the image carrier and the rotating member, and cancels the retracted state at the other end by enabling the rotating member to be rotated by the image carrier, moving the second gap-maintaining member, and cancelling a gap-maintaining state established by the second gap-maintaining member.

11 Claims, 15 Drawing Sheets

IMAGE FORMING APPARATUS

CROSS-REFERENCE TO RELATED APPLICATIONS

This application is based on and claims priority under 35 USC 119 from Japanese Patent Application No. 2015-040952 filed Mar. 3, 2015.

BACKGROUND

Technical Field

The present invention relates to an image forming apparatus.

SUMMARY

According to an aspect of the invention, there is provided an image forming apparatus including an image carrier that carries a toner image and that is rotatable; a drive mechanism that is provided at one end of the image carrier and that drives the image carrier so as to rotate the image carrier; a rotating member that comes into contact with the image carrier so as to be rotated by the image carrier; an urging member that urges the rotating member in a direction toward the image carrier; and a retracting system that retains the rotating member in a retracted state in which the rotating member is positioned so as not to be in contact with the image carrier, and cancels the retracted state of the rotating member so that a peripheral surface of the rotating member comes into contact with the image carrier when the drive mechanism starts to drive the image carrier. The retracting system includes a first retracting mechanism and a second retracting mechanism. The first retracting mechanism includes a first gap-maintaining member that is provided on a shaft portion of the rotating member at an end adjacent to the drive mechanism and that maintains a gap between the image carrier and the peripheral surface of the rotating member. The first retracting mechanism cancels the retracted state of the rotating member at one end in an axial direction by moving the first gap-maintaining member in response to an operation of the drive mechanism and cancelling a gap-maintaining state established by the first gap-maintaining member. The second retracting mechanism includes a second gap-maintaining member that is provided on the shaft portion of the rotating member at the other end and that maintains a gap between the image carrier and the peripheral surface of the rotating member. The second retracting mechanism cancels the retracted state of the rotating member at the other end in the axial direction by enabling the rotating member to be rotated by the image carrier when the retracted state of the rotating member is cancelled by the first retracting mechanism and when the peripheral surface of the rotating member comes into contact with the image carrier, moving the second gap-maintaining member in response to a rotation of the rotating member, and cancelling a gap-maintaining state established by the second gap-maintaining member.

BRIEF DESCRIPTION OF THE DRAWINGS

Exemplary embodiments of the present invention will be described in detail based on the following figures, wherein:

FIGS. 1A to 1C illustrate an image forming apparatus according to an exemplary embodiment of the present invention, wherein FIG. 1B is an enlarged view of a portion of the image forming apparatus viewed in the direction of arrow IB in FIG. 1A, and FIG. 1C is an enlarged view of a portion of the image forming apparatus viewed in the direction of arrow IC in FIG. 1A;

FIG. 4A illustrates the positional relationship between a photoconductor and a transfer roller before the start of operation of the image forming apparatus according to the first exemplary embodiment, wherein

DETAILED DESCRIPTION

Summary of Exemplary Embodiments

Figure 1A:
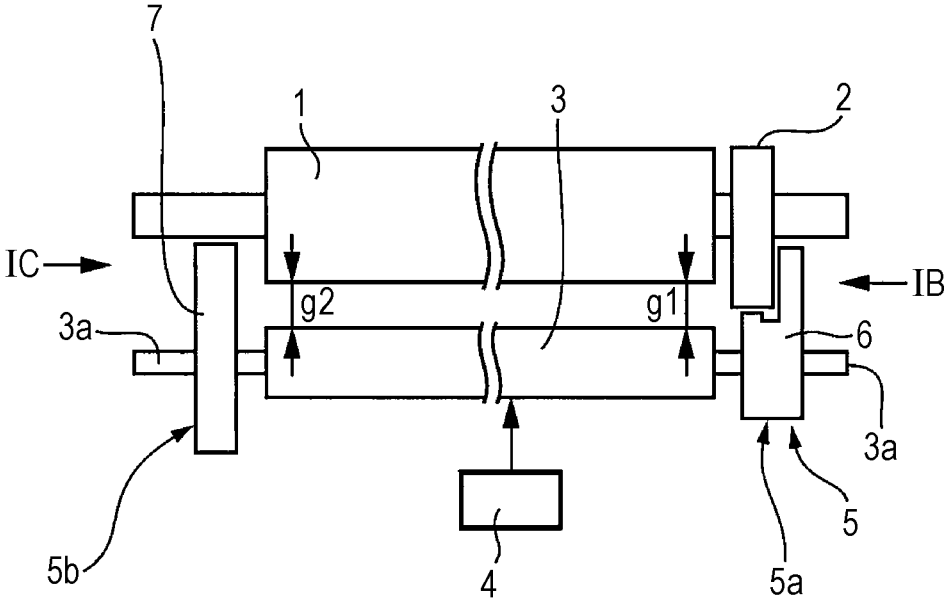
Figure 1B:
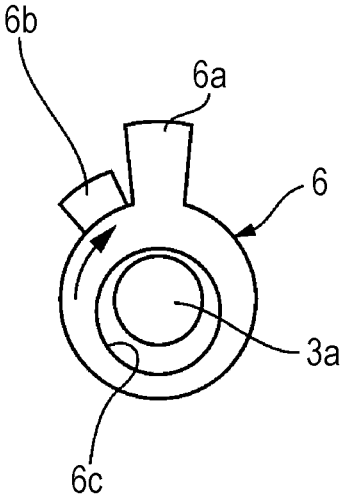
Figure 1C:
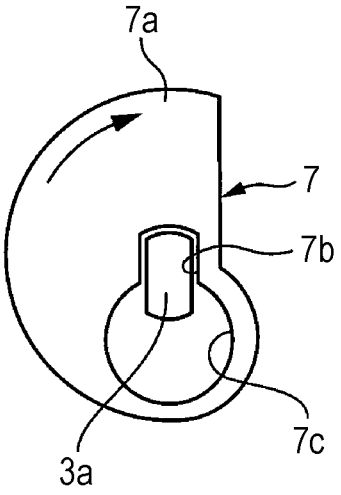

FIGS. 1A to 1C illustrate an image forming apparatus according to an exemplary embodiment of the present invention. FIG. 1B is an enlarged view of a portion of the image forming apparatus viewed in the direction of arrow IB in FIG. 1A, and FIG. 1C is an enlarged view of a portion of the image forming apparatus viewed in the direction of arrow IC in FIG. 1A.

Referring to FIGS. 1A to 1C, the image forming apparatus includes an image carrier 1 that carries a toner image and that is rotatable; a drive mechanism 2 that is provided at one end of the image carrier 1 and that drives the image carrier 1 so as to rotate the image carrier 1; a rotating member 3 that comes into contact with the image carrier 1 so as to be rotated by the image carrier 1; an urging member 4 that urges the rotating member 3 in a direction toward the image carrier 1; and a retracting system 5 that retains the rotating member 3 in a retracted state in which the rotating member 3 is positioned so as not to be in contact with the image carrier 1, and cancels the retracted state of the rotating member 3 so that a peripheral surface of the rotating member 3 comes into contact with the image carrier 1 when the drive mechanism 2 starts to drive the image carrier 1. The retracting system 5 includes a first retracting mechanism 5*a* and a second retracting mechanism 5*b*. The first retracting mechanism 5*a* includes a first gap-maintaining member 6 that is provided on a shaft portion of the rotating member 3 at an end adjacent to the drive mechanism 2 and that maintains a gap g1 between the image carrier 1 and the peripheral surface of the rotating member 3. The first retracting mechanism 5*a* cancels the retracted state of the rotating member 3 at one end in an axial direction by moving the first gap-maintaining member 6 in response to an operation of the drive mechanism 2 and cancelling a gap-maintaining state established by the first gap-maintaining member 6. The second retracting mechanism 5*b* includes a second gap-maintaining member 7 that is provided on the shaft portion of the rotating member 3 at the other end and that maintains a gap g2 between the image carrier 1 and the peripheral surface of the rotating member 3. The second retracting mechanism 5*b* cancels the retracted state of the rotating member 3 at the other end in the axial direction by enabling the rotating member 3 to be rotated by the image carrier 1 when the retracted state of the rotating member 3 is cancelled by the first retracting mechanism 5*a* and when the peripheral surface of the rotating member 3 comes into contact with the image carrier 1, moving the second gap-maintaining member 7 in response to a rotation of the rotating member 3, and cancelling a gap-maintaining state established by the second gap-maintaining member 7.

In this technical concept, a typical example of the image carrier 1 is a drum-shaped photoconductor including a photosensitive layer formed of an organic photo conductor (OPC). There is no particular limitation regarding the rotating member 3 as long as the rotating member 3 may be rotated by the image carrier 1 in operation. The rotating member 3 may be, for example, a roll-shaped transfer member or charging member. There is also no particular limitation regarding the drive mechanism 2 as long as the drive mechanism 2 is capable of directly or indirectly driving the image carrier 1, and a known system may be used. There is also no particular limitation regarding the type of the urging member 4 as long as the rotating member 3 may be urged in such a direction as to reduce the gaps g1 and g2 between the image carrier 1 and the rotating member 3, that is, in a direction toward the image carrier 1. A typical example of the urging member 4 is a coil spring.

The retracting system 5 according to the present exemplary embodiment is configured to maintain the retracted state, in which the rotating member 3 is separated from the image carrier 1, until the operation of the apparatus is started, and cancels the retracted state to bring the image carrier 1 and the rotating member 3 into contact with each other when the operation of the apparatus is started.

There is no particular limitation regarding the materials of the first gap-maintaining member 6 and the second gap-maintaining member 7. From the viewpoint of, for example, the sliding performance and mechanical strength of a shaft portion 3*a* of the rotating member 3, polyoxymethylene (POM) may be used.

The retracting system 5 according to the present exemplary embodiment performs the operation of cancelling the retracted state, in which the rotating member 3 is separated from the image carrier 1, by a single contact method.

More specifically, in the present exemplary embodiment, the retracting system 5 includes the first retracting mechanism 5*a* provided on the shaft portion of the rotating member 3 at the end adjacent to the drive mechanism 2, and the second retracting mechanism 5*b* provided on the shaft portion of the rotating member 3 at the other end. When the operation of the apparatus is started, the drive mechanism 2 drives the rotating member 3 so as to rotate the rotating member 3, thereby making the first retracting mechanism 5*a* cancel the retracted state so that one end portion of the rotating member 3 in the axial direction comes into contact with the image carrier 1, that is, so that the rotating member 3 comes into contact with the image carrier 1 at one end thereof. Then, the rotating member 3 is rotated, which makes the second retracting mechanism 5*b* cancel the retracted state so that the other end portion of the rotating member 3 in the axial direction comes into contact with the image carrier 1. As a result, the image carrier 1 and the rotating member 3 come into contact with each other over the entire region thereof.

Figure 2A:
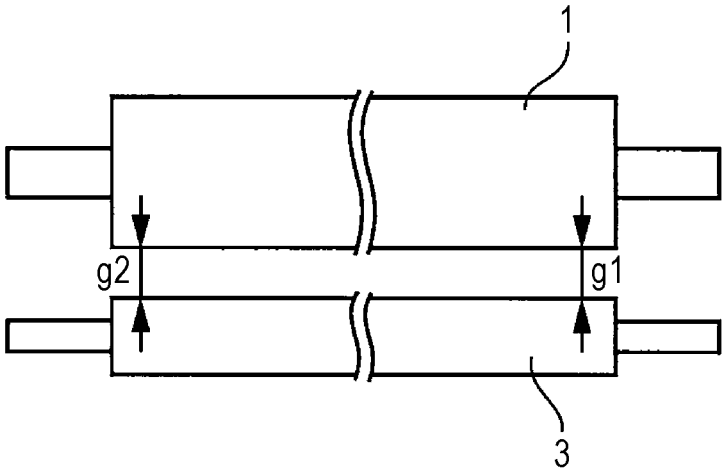
FIGS. 2A to 2C illustrate the relationships between an image carrier and a rotating member according to the exemplary embodiment.
Figure 2B:
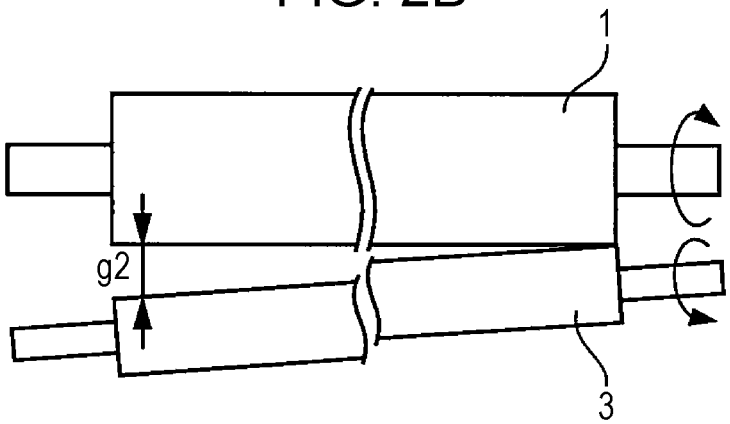
Figure 2C:
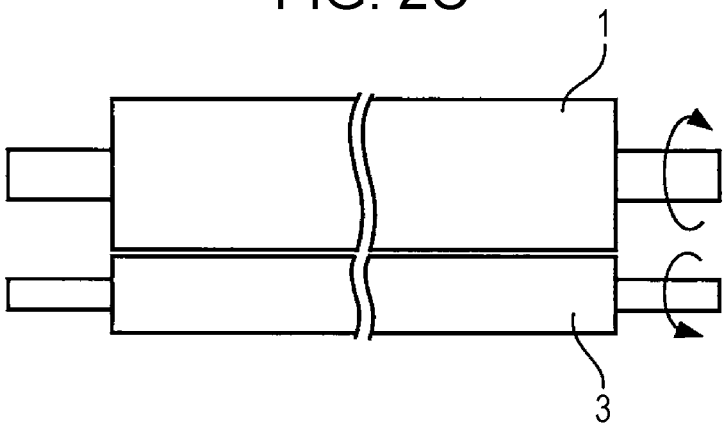

FIGS. 2A to 2C illustrate the relationship between the image carrier 1 and the rotating member 3 according to the present exemplary embodiment.

As illustrated in FIG. 2A, when the operation of the apparatus is not yet started, the gaps g1 and g2 are maintained between the image carrier 1 and the rotating member 3 at both ends thereof, so that the image carrier 1 and the rotating member 3 are separated from each other. When the operation of the image forming apparatus is started, as illustrated in FIG. 2B, first, the state in which the gap g1 is maintained at one end of the rotating member 3 is cancelled so that the peripheral surface of the rotating member 3 comes into contact with the image carrier 1. Accordingly, the rotating member 3 starts to rotate in response to the rotation of the image carrier 1. When the rotating member 3 is rotated by a predetermined amount, as illustrated in FIG. 2C, the state in which the gap g2 is maintained at the other end of the rotating member 3 is cancelled so that the image carrier 1 and the rotating member 3 come into contact with each other over the entire region thereof.

With the above-described retracting system 5 that uses the single contact method, compared to the case in which the image carrier 1 and the rotating member 3 are simultaneously brought into contact with each other over the entire region thereof, the torque required to make the rotating member 3 start to rotate may be reduced. In addition, the impact that occurs when image carrier 1 and the rotating member 3 come into contact with each other may also be reduced.

Typical or desirable modes of the image forming apparatus according to the present exemplary embodiment will be described with reference to FIGS. 1A to 1C.

The retracting system 5, which includes the first retracting mechanism 5*a* and the second retracting mechanism 5*b*, typically has the following structure. That is, the first gap-maintaining member 6 includes a first maintaining portion 6*a* provided on the shaft portion 3*a* of the rotating member 3 at the end adjacent to the drive mechanism 2 such that the first maintaining portion 6*a* is freely rotatable around the shaft portion 3*a*, the first maintaining portion 6*a* resisting an urging force applied by the urging member 4 so as to maintain the gap g1; a first link portion 6*b* that is operatively linked to the drive mechanism 2 so that the first maintaining portion 6*a* is rotated by a driving force applied by the drive mechanism 2 when an operation of the image forming apparatus is started; and a first cancelling portion 6*c* that cancels a gap-maintaining state established by the first maintaining portion 6*a* when the first maintaining portion 6*a* is rotated by a predetermined amount due to the first link portion 6*b*. The second gap-maintaining member 7 includes a second maintaining portion 7*a* provided on the shaft portion 3*a* of the rotating member 3 at an end opposite to the end adjacent to the drive mechanism 2 such that the second maintaining portion 7*a* is freely rotatable around the shaft portion 3*a*, the second maintaining portion 7*a* resisting the urging force applied by the urging member 4 so as to maintain the gap g2; a second link portion 7*b* that is operatively linked to the rotating member 3 so that the second maintaining portion 7*a* is rotated after the state in which the gap g1 is maintained is cancelled by the first cancelling portion 6*c*; and a second cancelling portion 7*c* that cancels a gap-maintaining state established by the second maintaining portion 7*a* when the second maintaining portion 7*a* is rotated by a predetermined amount due to the second link portion 7*b*.

There is no particular limitation regarding the first maintaining portion 6*a* and the second maintaining portion 7*a* as long as the gaps are provided between the shaft portion 3*a* of the rotating member 3 and the image carrier 1, and as long as the first maintaining portion 6*a* and the second maintaining portion 7*a* directly or indirectly maintain the gaps between the shaft portion 3*a* and the image carrier 1. The first maintaining portion 6*a* and the second maintaining portion 7*a* may maintain the gaps by being in contact with a rotating shaft of the image carrier 1 or with a body of the image carrier 1 (portion excluding the portion on which the photosensitive layer is formed). The first maintaining portion 6*a* and the second maintaining portion 7*a* may instead be in contact with a bracket or the like that supports the image carrier 1. Thus, there is no particular limitation as long as the gaps g1 and g2 are provided between the image carrier 1 and the rotating member 3.

There is no particular limitation regarding the first link portion 6*b* as long as the first link portion 6*b* is operatively linked to the drive mechanism 2. In general, the first link portion 6*b* includes a gear that meshes with a gear included in the drive mechanism 2. There is no particular limitation regarding the first cancelling portion 6*c* as long as the gap-maintaining state established by the first maintaining portion 6*a* is cancelled when the first maintaining portion 6*a* is rotated by a predetermined amount. When the gap-maintaining state is cancelled, the image carrier 1 and the rotating member 3 come into contact with each other at the end adjacent to the drive mechanism 2. As illustrated in FIG. 1B, the first cancelling portion 6*c* may have a hole formed in the first gap-maintaining member 6, the hole being larger than the shaft portion 3*a* of the rotating member 3. When such a hole is provided, the gap-maintaining state established by the first maintaining portion 6*a* is cancelled immediately after the gap-maintaining function of the first maintaining portion 6*a* is lost.

There is no particular limitation regarding the second link portion 7*b* as long as the second link portion 7*b* enables the second maintaining portion 7*a* to be rotated in response to the rotation of the rotating member 3. For example, in the case where the shaft portion 3*a* of the rotating member 3 has D-cut portions, the second gap-maintaining member 7 may have a hole including a portion having a shape corresponding to the shape of the D-cut portions, as illustrated in FIG. 1C, so that the second maintaining portion 7*a* may be rotated together with the D-cut portions. Alternatively, in the case where the shaft portion 3*a* of the rotating member 3 has a pin-shaped projection, the second maintaining portion 7*a* may be rotated together with the pin-shaped projection. This will be described in more detail below.

There is no particular limitation regarding the second cancelling portion 7*c* as long as the state in which the gap g2 is maintained is cancelled when the second maintaining portion 7*a* is rotated in a predetermined manner. When the state in which the gap g2 is maintained is cancelled, the image carrier 1 and the rotating member 3 come into contact with each other over the entire region thereof. As illustrated in FIG. 1C, the second gap-maintaining member 7 may have a hole including a portion larger than the shaft portion 3*a* of the rotating member 3. When such a hole is provided, the state in which the gap g2 is maintained is cancelled immediately after the gap-maintaining function of the second maintaining portion 7*a* is lost.

From the viewpoint of preventing the first gap-maintaining member 6 and the second gap-maintaining member 7 from falling in the image forming apparatus, the retracting system 5, which includes the first retracting mechanism 5*a* and the second retracting mechanism 5*b*, may be configured such that the first gap-maintaining member 6 freely rotates around the shaft portion 3*a* of the rotating member 3 after the state in which the gap g1 is maintained is cancelled by the first cancelling portion 6*c*, and the second gap-maintaining member 7 freely rotates around the shaft portion 3*a* of the rotating member 3 after the state in which the gap g2 is maintained is cancelled by the second cancelling portion 7*c*.

In the present exemplary embodiment, even after the state in which the rotating member 3 is retracted by the retracting system 5 is cancelled, the first gap-maintaining member 6 and the second gap-maintaining member 7, which are included in the retracting system 5, remain on the shaft portion 3*a* of the rotating member 3. Accordingly, damages caused when the gap-maintaining members 6 and 7 fall may be prevented.

From the viewpoint of reliably maintaining the gaps g1 and g2 between the image carrier 1 and the peripheral surface of the rotating member 3 when the operation of the image forming apparatus is not yet started, the drive mechanism 2 may include a gear that rotates when the image carrier 1 is rotated, and the first link portion 6*b* may include a gear-shaped portion that has a predetermined number of teeth and that meshes with the gear. In the case where the gear included in the drive mechanism 2 meshes with the first link portion 6*b*, movement of the first link portion 6*b* is regulated. As a result, the positional relationship between the image carrier 1 and the first gap-maintaining member 6 is maintained constant, and there is no risk that the first gap-maintaining member 6 will rotate. Accordingly, the gap g1 is reliably maintained by the first gap-maintaining member 6, and the gap g2 is reliably maintained by the second gap-maintaining member 7.

From the viewpoint of enabling the first gap-maintaining member 6 and the second gap-maintaining member 7 to freely rotate in a stable position after the state in which the gaps g1 and g2 are maintained by the first and second gap-maintaining members 6 and 7 is cancelled, the first and second gap-maintaining members 6 and 7 may be structured as follows. That is, a first restraining portion (not shown) may be provided to restrain the first gap-maintaining member 6 from rotating in the same direction as a direction in which the rotating member 3 rotates after the state in which the gap g1 is maintained is cancelled by the first cancelling portion 6*c*, and a second restraining portion (not shown) may be provided to restrain the second gap-maintaining member 7 from rotating in the same direction as the direction in which the rotating member 3 rotates after the state in which the gap g2 is maintained is cancelled by the second cancelling portion 7*c*. More specifically, after the state in which the gap g1 is maintained by the first gap-maintaining member 6 is cancelled, the first gap-maintaining member 6 is influenced by an inertial force generated by the rotation of the rotating member 3 in the direction in which the rotating member 3 rotates. The influence of the inertial force may be reduced by providing the first gap-maintaining member 6 with a weight balance for utilizing the gravitational force. However, when the above-described restraining portions are provided, the stability of the position of the first gap-maintaining member 6 may be further increased. This also applies to the second gap-maintaining member 7.

The rotating member 3 included in the image forming apparatus according to the present exemplary embodiment typically has either of the following two structures.

That is, the rotating member 3 may be a transfer member that is capable of coming into contact with the image carrier 1 and that transfers the toner image carried by the image carrier 1 onto a recording medium, or a charging member that is capable of coming into contact with the image carrier 1 and that charges the image carrier 1 to a predetermined charging potential. In either case, the image carrier 1 and the rotating member 3 are reliably maintained in the separated state until the operation of the image forming apparatus is started, and are brought into contact with each other without manual operation when the operation of the image forming apparatus is started.

The present invention will be described in more detail on the basis of exemplary embodiments illustrated in the accompanying drawings.

First Exemplary Embodiment

Overall Structure of Image Forming Apparatus

Figure 3:
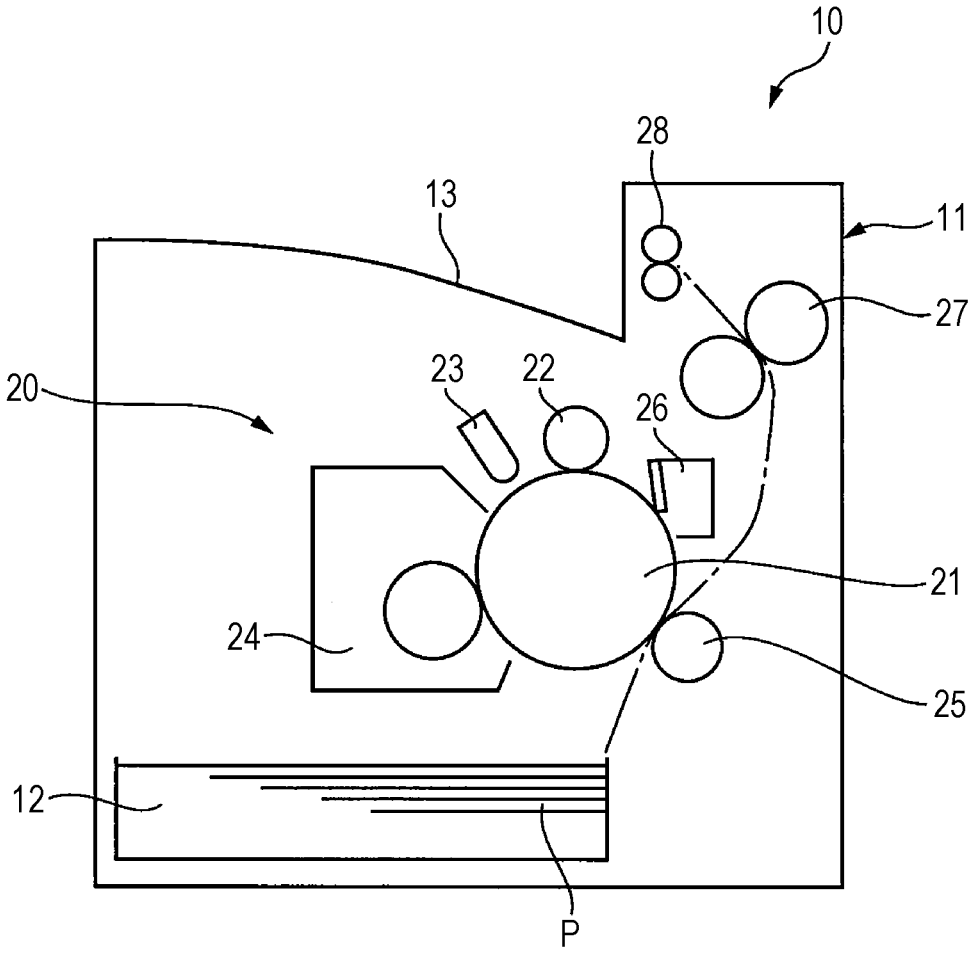
FIG. 3 illustrates the overall structure of an image forming apparatus according to a first exemplary embodiment.

FIG. 3 illustrates an image forming apparatus 10 according to a first exemplary embodiment of the present invention.

Referring to FIG. 3, the image forming apparatus 10 has the structure of a monochrome printer, and includes an apparatus housing 11 containing an image forming unit 20 that forms a toner image on a recording medium P. A recording-medium supplying unit 12, which supplies recording media P, is disposed in a lower section of the apparatus housing 11. A portion of the top surface of the apparatus housing 11 is formed as a recording-medium receiver 13 which receives the recording media P on which toner images are formed.

The image forming unit 20 includes a drum-shaped photoconductor 21 that serves as an image carrier and around which devices used to form an image are arranged. These devices include a charging device 22 that charges the photoconductor 21 to a predetermined charging potential, an exposure device 23 that irradiates the charged photoconductor 21 with light to form a latent image, a developing device 24 that develops the latent image formed on the photoconductor 21 by using toner, a transfer roller 25 which serves as a transfer member for transferring the toner image developed on the photoconductor 21 onto a recording medium P, and a cleaning device 26 that cleans the photoconductor 21 after the toner image has been transferred. A fixing device 27, which fixes the toner image formed on the recording medium P by the image forming unit 20 to the recording medium P, and output rollers 28, which output the recording medium P to which the toner image is fixed to the recording-medium receiver 13, are disposed above the image forming unit 20 in the apparatus housing 11.

The photoconductor 21 according to the present exemplary embodiment may be rotationally driven by a drive mechanism (not shown), and the transfer roller 25 is brought into contact with the photoconductor 21 so that the transfer roller 25 is rotated by the photoconductor 21.

In this structure, the photoconductor 21 may include a photosensitive layer made of, for example, OPC, and a rubber roller may be used as the transfer roller 25. When the photoconductor 21 and the transfer roller 25 are in contact with each other for a long time, migration of plasticizer or the like contained in the rubber component may occur. As a result, degradation of the contact portion of the photosensitive layer, mechanical deformation of the photosensitive layer, or mechanical deformation of the transfer roller 25 may occur. When the image forming apparatus 10 is operated in this state, there is a risk that the image quality will be degraded.

In the present exemplary embodiment, to reduce the risk of, for example, degradation of image quality, the photoconductor 21 and the transfer roller 25 are separated from each other when the operation of the image forming apparatus 10 is not yet started, and are brought into contact with each other without manual operation when the operation of the image forming apparatus 10 is started.

Figure 4A:
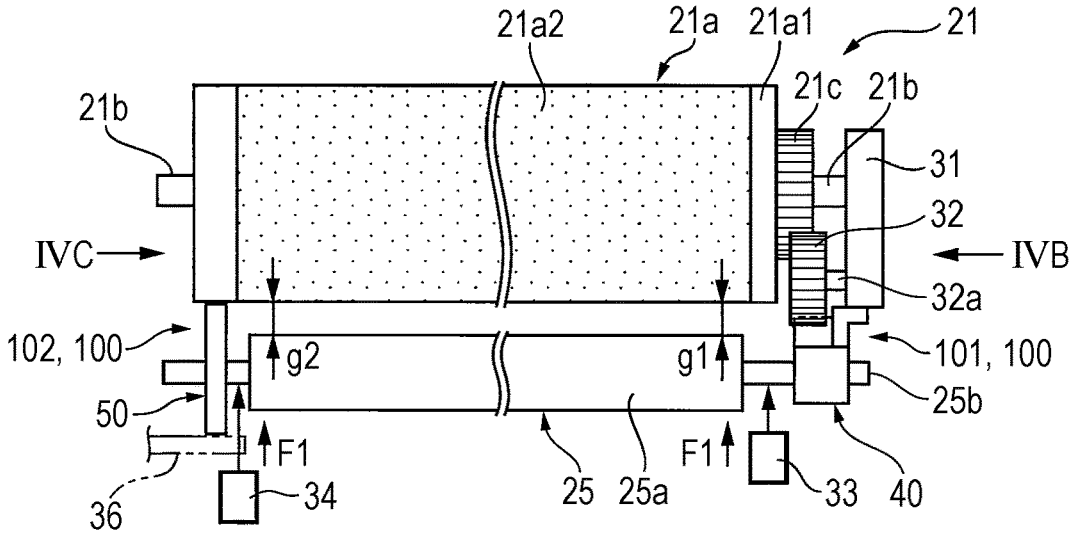
Figure 4B:
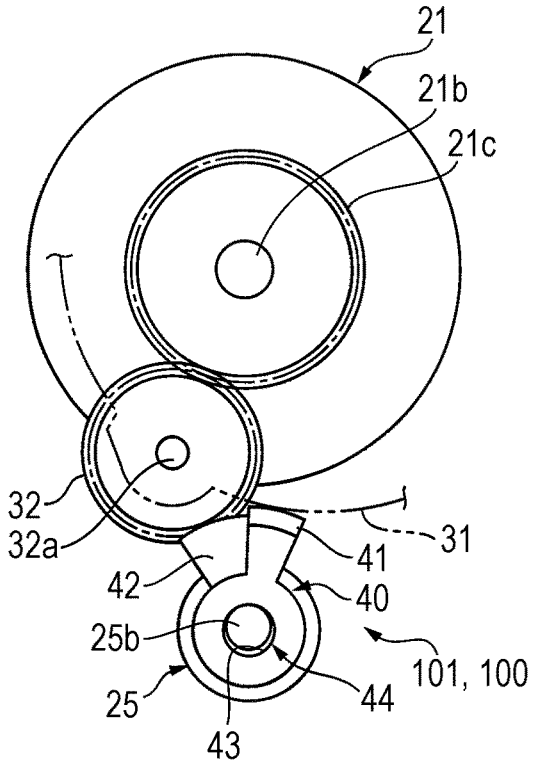
FIG. 4B is an enlarged view of the image forming apparatus viewed in the direction of arrow IVB in FIG. 4A.

FIG. 4A illustrates the positional relationship between the photoconductor 21 and the transfer roller 25 before the start of operation of the image forming apparatus 10. FIG. 4B is an enlarged view of the image forming apparatus 10 viewed in the direction of arrow IVB in FIG. 4A, and FIG. 4C is an enlarged view of the image forming apparatus 10 viewed in the direction of arrow IVC in FIG. 4A.

Figure 4C:
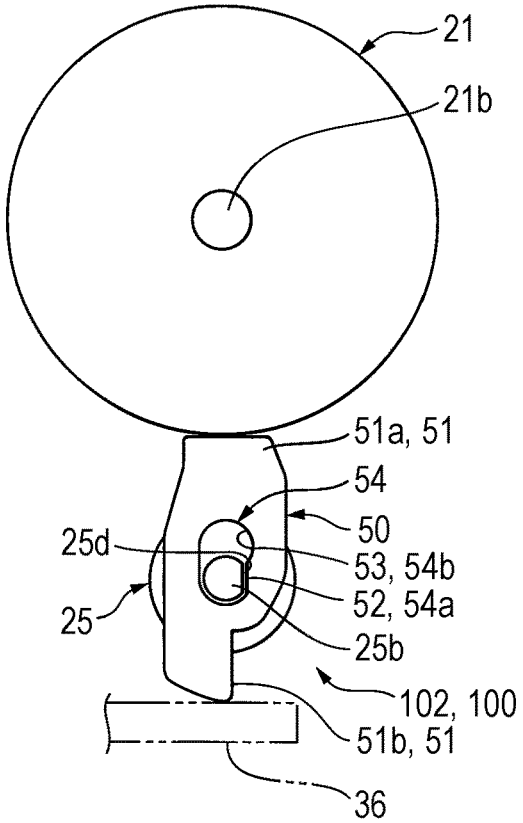
FIG. 4C is an enlarged view of the image forming apparatus viewed in the direction of arrow IVC in FIG. 4A.

Referring to FIGS. 4A to 4C, the photoconductor 21 includes a photoconductor body 21*a* including a pipe 21*a*1 and a photosensitive layer 21*a*2 provided on the pipe 21*a*1, a rotating shaft 21*b* that supports the photoconductor body 21*a*, and a photoconductor gear 21*c* that is fixed to the rotating shaft 21*b* and the photoconductor body 21*a*. One end of the rotating shaft 21*b* is rotatably supported by a bracket 31, which is supported by, for example, the apparatus housing 11 (see FIG. 3), and other end of the rotating shaft 21*b* is rotatably supported by a bracket or the like (not shown). The photoconductor 21 may be rotationally driven by a drive mechanism including a motor (not shown). The drive mechanism may be of any type as long as the photoconductor 21 may be rotated. For example, a rotating force generated by the motor (not shown) may be transmitted to the photoconductor gear 21*c* through another gear or the like.

The transfer roller 25 includes a transfer roller body 25*a* including a portion that comes into contact with the photosensitive layer 21*a*2 of the photoconductor body 21*a*, and a shaft portion 25*b* that supports the transfer roller body 25*a*.

Urging members 33 and 34, which urge the shaft portion 25*b* toward the photoconductor 21, are provided at both ends of the shaft portion 25*b*. Each of the urging members 33 and 34 exerts a force F1 that urges the shaft portion 25*b* toward the photoconductor 21. An intermediate gear 32 meshes with the photoconductor gear 21*c* and applies a rotating force to a first gap-maintaining member 40, which will be described below. In the present exemplary embodiment, the intermediate gear 32 is a component of the drive mechanism.

Retracting System

In the present exemplary embodiment, a retracting system 100 is provided between the photoconductor 21 and the transfer roller 25. The retracting system 100 retains the transfer roller 25 at a retracted position, at which the transfer roller 25 is not in contact with the photoconductor 21, until the operation of the image forming apparatus 10 is started. When the operation of the image forming apparatus 10 is started, more specifically, when the drive mechanism starts to drive the photoconductor 21, the retracted state of the transfer roller 25 is cancelled so that the peripheral surface of the transfer roller 25 is brought into contact with the photoconductor 21.

In the present exemplary embodiment, the retracting system 100 includes a first retracting mechanism 101 and a second retracting mechanism 102. The first retracting mechanism 101 includes a first gap-maintaining member 40 that is provided on the shaft portion 25*b* of the transfer roller 25 at an end adjacent to the drive mechanism of the photoconductor 21 and that maintains a gap between the photoconductor 21 and the peripheral surface of the transfer roller 25. The first retracting mechanism 101 cancels the retracted state of the transfer roller 25 at one end in an axial direction by moving the first gap-maintaining member 40 in response to an operation of the drive mechanism of the photoconductor 21 and cancelling a gap-maintaining state established by the first gap-maintaining member 40. The second retracting mechanism 102 includes a second gap-maintaining member 50 that is provided on the shaft portion 25*b* of the transfer roller 25 at the other end and that maintains a gap between the photoconductor 21 and the peripheral surface of the transfer roller 25. The second retracting mechanism 102 cancels the retracted state of the transfer roller 25 at the other end in the axial direction by enabling the transfer roller 25 to be rotated by the photoconductor 21 when the retracted state of the transfer roller 25 is cancelled by the first retracting mechanism 101 and when the peripheral surface of the transfer roller 25 comes into contact with the photoconductor 21, moving the second gap-maintaining member 50 in response to a rotation of the transfer roller 25, and cancelling a gap-maintaining state established by the second gap-maintaining member 50.

In the present exemplary embodiment, the first gap-maintaining member 40 and the second gap-maintaining member 50 are provided on the shaft portion 25*b* of the transfer roller 25 at both ends of the shaft portion 25*b* such that the first and second gap-maintaining members 40 and 50 are freely rotatable around the shaft portion 25*b*. The first gap-maintaining member 40 is provided at the end adjacent to the drive mechanism of the photoconductor 21 (at the end where the photoconductor gear 21*c* is provided in the present exemplary embodiment). The second gap-maintaining member 50 is provided at the end opposite to the end adjacent to the drive mechanism. The first and second gap-maintaining members 40 and 50 respectively maintain the first and second gaps g1 and g2 between the photoconductor 21 (more specifically, the photoconductor body 21*a*) and the transfer roller 25 (more specifically, the transfer roller body 25*a*) at the end adjacent to the drive mechanism and the end opposite thereto. The first and second gaps g1 and g2 are set so as to be substantially equal to each other such that the photoconductor 21 and the transfer roller 25 are prevented from coming into contact with each other even when the amounts by which components are bent are taken into consideration.

Structures of First and Second Gap-Maintaining Members

The structures of the first gap-maintaining member 40 and the second gap-maintaining member 50 will be described with reference to FIGS. 4A to 4C.

First Gap-Maintaining Member

The first gap-maintaining member 40 is made of, for example, POM, and includes a first maintaining portion 41 provided on the shaft portion 25*b* of the transfer roller 25 at the end adjacent to the drive mechanism of the photoconductor 21 such that the first maintaining portion 41 is freely rotatable around the shaft portion 25*b*, the first maintaining portion 41 resisting the urging force of the urging member 33 so as to maintain the gap g1; a first link portion 42 that is operatively linked to the drive mechanism so that the first maintaining portion 41 is rotated by the driving force applied by the drive mechanism when the operation of the image forming apparatus is started; and a first cancelling portion 43 that cancels the state in which the gap g1 is maintained by the first gap-maintaining member 40 when the first maintaining portion 41 is rotated by a predetermined amount due to the first link portion 42.

In the present exemplary embodiment, the diameter of the first gap-maintaining member 40 is greater than the diameter of the shaft portion 25*b* of the transfer roller 25, and has a hole 44 through which the shaft portion 25*b* extends. This hole 44 corresponds to the first cancelling portion 43. This will be described in detail below. According to the present exemplary embodiment, the rotating shaft 32*a* of the intermediate gear 32 is rotatably supported by the bracket 31, and the first link portion 42 of the first gap-maintaining member 40 has gear teeth 42*g* (see FIGS. 5A to 5C). The gear teeth of the intermediate gear 32 and the first link portion 42 mesh with each other.

Second Gap-Maintaining Member

The second gap-maintaining member 50 is made of, for example, POM, and includes second maintaining portions 51 (two second maintaining portions 51*a* and 51*b* in the present exemplary embodiment) provided on the shaft portion 25*b* of the transfer roller 25 at the end opposite to the end adjacent to the drive mechanism of the photoconductor 21 such that the second maintaining portions 51 are freely rotatable around the shaft portion 25*b*, the second maintaining portions 51 resisting the urging force of the urging member 34 so as to maintain the gap g2 (g2=g1 in the present exemplary embodiment); a second link portion 52 that is operatively linked to the transfer roller 25 so that the second maintaining portions 51 are rotated after the state in which the gap g1 is maintained by the first gap-maintaining member 40 is cancelled; and a second cancelling portion 53 that cancels the state in which the gap g2 is maintained when the second maintaining portions 51 are rotated by a predetermined amount due to the second link portion 52.

In the present exemplary embodiment, the second gap-maintaining member 50 has a hole 54. The hole 54 includes a hole portion 54*a* having a shape that corresponds to the shape of the shaft portion 25*b* of the transfer roller 25, and a hole portion 54*b* that is connected to the hole portion 54*a* and has a diameter greater than the diameter of the shaft portion 25*b*. The shaft portion 25*b* of the transfer roller 25 has a D-cut portion 25*d*. The hole portion 54*a*, which has a shape corresponding to that of the D-cut portion 25*d*, corresponds to the second link portion 52, and the hole portion 54*b*, which has a diameter greater than the diameter of the shaft portion 25*b*, corresponds to the second cancelling portion 53. A bracket 36 is supported by, for example, the apparatus housing 11 (see FIG. 3).

Operation Performed when Image Forming Apparatus is in Operation

Assume that the image forming apparatus 10 is in operation, that is, the transfer roller 25 is in contact with the photoconductor 21. As illustrated in FIG. 3, in the image forming apparatus 10, the toner image formed on the photoconductor 21 by the image forming unit 20 is transferred onto a recording medium P, which is supplied by the recording-medium supplying unit 12, in a transfer section between the photoconductor 21 and the transfer roller 25. The toner image that has been transferred onto the recording medium P is fixed by the fixing device 27, and then the recording medium P is output to the recording-medium receiver 13 by the output rollers 28.

Operation Performed Before Start of Operation of Image Forming Apparatus

The operation performed before the operation of the image forming apparatus 10 is started, that is, for example, when the image forming apparatus 10 is being stored or transported, will be described. When the operation of the image forming apparatus 10 is not yet started, the photoconductor 21 and the transfer roller 25 are separated from each other. Referring to FIGS. 4A to 4C, since the gear teeth of the first link portion 42 of the first gap-maintaining member 40 and the intermediate gear 32 mesh with each other, the state in which the first maintaining portion 41 is in contact with the bracket 31 is maintained, so that the gap g1 is maintained. Since the transfer roller 25 is separated from the photoconductor 21, the transfer roller 25 is not rotated, and the second gap-maintaining member 50 is disposed at a predetermined initial position. Therefore, the state in which the second maintaining portions 51 (51*a* and 51*b*) of the second gap-maintaining member 50 are in contact with the photoconductor 21 and the bracket 36 is maintained, so that the gap g2 is maintained.

As described above, when the operation of the image forming apparatus 10 is not yet started, the gaps g1 and g2 are reliably maintained by the first gap-maintaining member 40 and the second gap-maintaining member 50, respectively. Therefore, the image forming apparatus 10 has sufficient resistance not only when the image forming apparatus 10 is stored but also when the image forming apparatus 10 is being transported or installed. Thus, the photoconductor 21 and the transfer roller 25 are reliably separated from each other for a long time.

When Operation of Image Forming Apparatus is Started

Figure 5C:
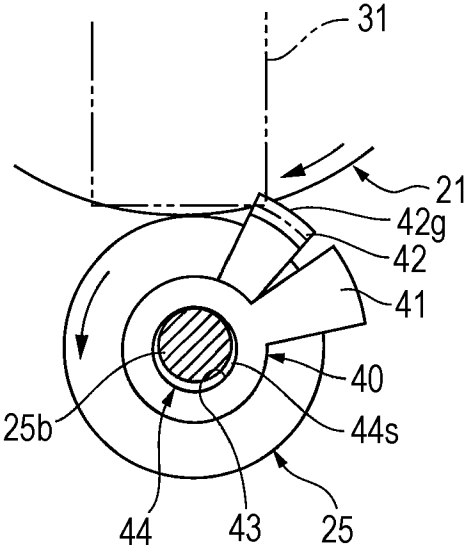
FIGS. 5A to 5C illustrate the movement of a first gap-maintaining member, included in a first retracting mechanism, when the operation of the image forming apparatus according to the first exemplary embodiment is started.
Figure 5B:
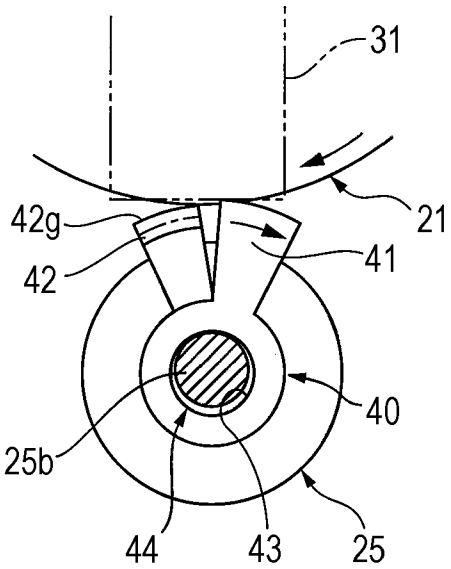
Figure 5A:
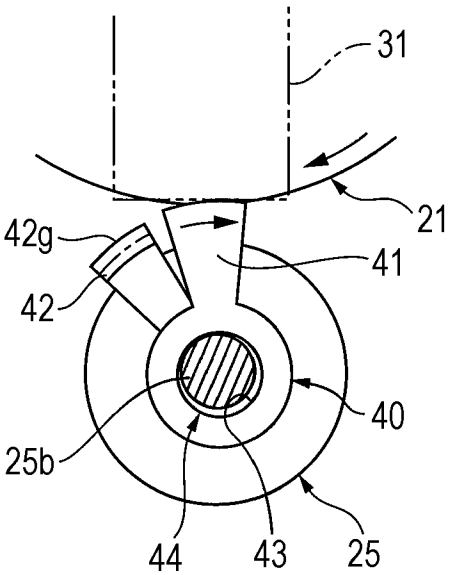

Assume that the operation of the image forming apparatus 10 is started. FIGS. 5A to 5C illustrate the movement of the first gap-maintaining member 40 when the operation of the image forming apparatus 10 is started. FIGS. 4A to 4C are also referred to in the following description.

Operation of First Gap-Maintaining Member

When the operation of the image forming apparatus 10 is started, the photoconductor gear 21*c* starts to rotate at, for example, warm-up time. As illustrated in FIG. 5A, when the photoconductor gear 21*c* is rotated, the first link portion 42 of the first gap-maintaining member 40 is rotated by the intermediate gear 32 (see FIG. 4A), so that the first gap-maintaining member 40 starts to rotate around the shaft portion 25*b* of the transfer roller 25. The first maintaining portion 41 is continuously in contact with the bracket 31, so that the gap g1 between the photoconductor 21 and the transfer roller 25 is maintained. At this time, the transfer roller 25 is not yet rotated.

As illustrated in FIG. 5B, the state in which the first maintaining portion 41 of the first gap-maintaining member 40 is in contact with the bracket 31 is maintained until the intermediate gear 32 is further rotated and becomes disengaged from the first link portion 42. Also at this time, the transfer roller 25 is not rotated.

When the intermediate gear 32 is further rotated, the intermediate gear 32 becomes disengaged from the first link portion 42. Then, as illustrated in FIG. 5C, since a gap 44*s* is provided between the inner surface of the hole 44 in the first gap-maintaining member 40 and the shaft portion 25*b* of the transfer roller 25, the first maintaining portion 41 becomes separated from the bracket 31 due to the urging force of the urging member 33 (see FIG. 4A), and moves downward in FIG. 5C. Thus, the first gap-maintaining member 40 becomes freely rotatable around the shaft portion 25*b*. As a result, the gap g1 provided by the first gap-maintaining member 40 is eliminated and the photoconductor 21 and the transfer roller 25 come into contact with each other at the end at which the first gap-maintaining member 40 is provided. Accordingly, the transfer roller 25 starts to rotate in response to the rotation of the photoconductor 21.

According to the present exemplary embodiment, the first link portion 42 of the first gap-maintaining member 40 and the intermediate gear 32 are configured to mesh with each other so that the first maintaining portion 41 may be rotated by a predetermined amount. The hole 44 in the first gap-maintaining member 40 includes a portion having a diameter greater than that of the shaft portion 25*b* of the transfer roller 25. Therefore, the first gap-maintaining member 40 is released from the restrained state after the first maintaining portion 41 is rotated by a predetermined amount. Thus, the hole 44 corresponds to the first cancelling portion 43 according to the present exemplary embodiment. In the states illustrated in FIGS. 5A and 5B, even when the first gap-maintaining member 40 is rotated by the intermediate gear 32, the rotation is not transmitted between the hole 44 and the shaft portion 25*b* of the transfer roller 25, and the transfer roller 25 remains stationary (in a freely rotatable state).

Figure 6:
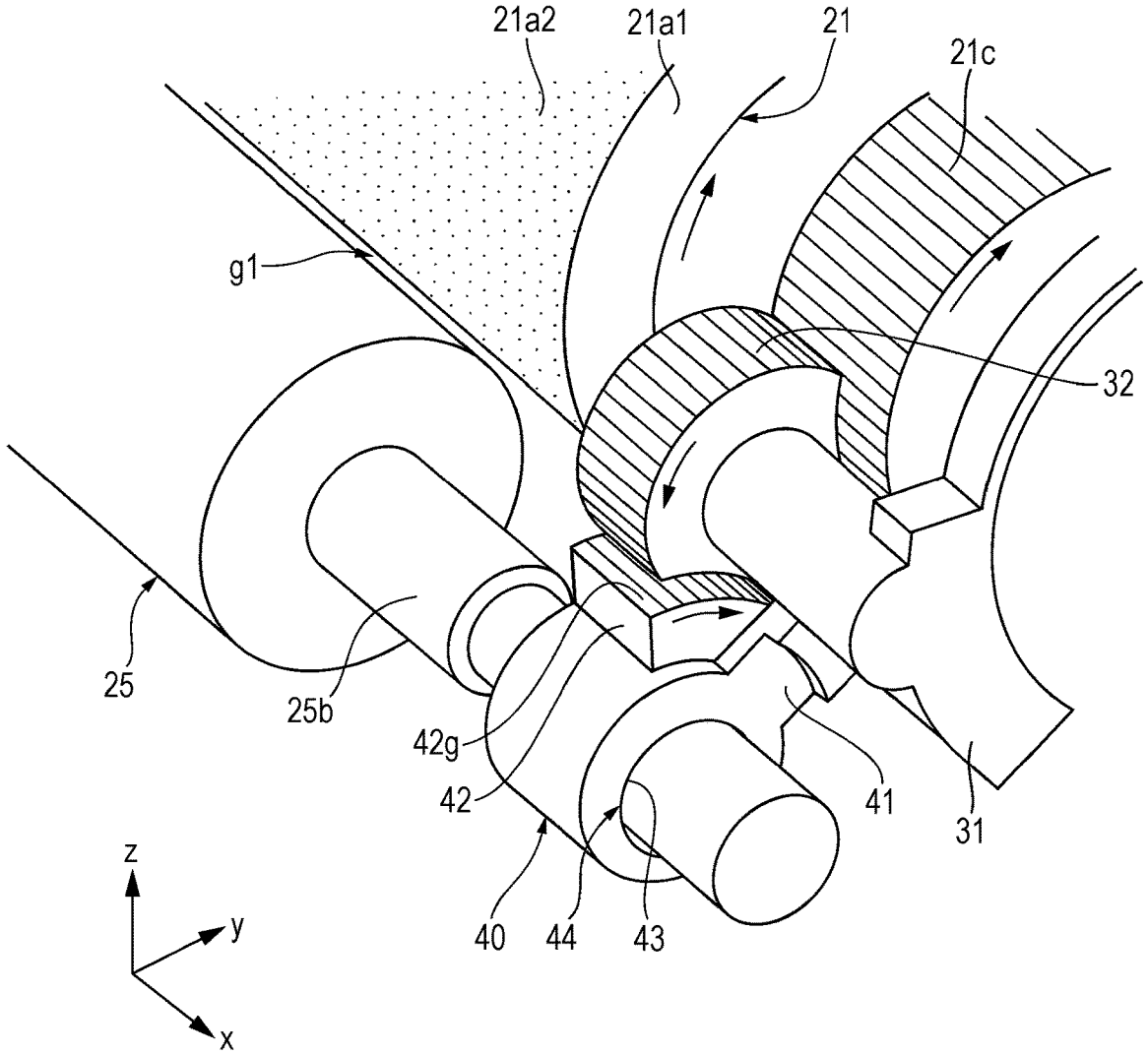
FIG. 6 is a partial perspective view illustrating a state before a gap-maintaining state established by the first gap-maintaining member included in the first retracting mechanism according to the first exemplary embodiment is cancelled.
Figure 7:
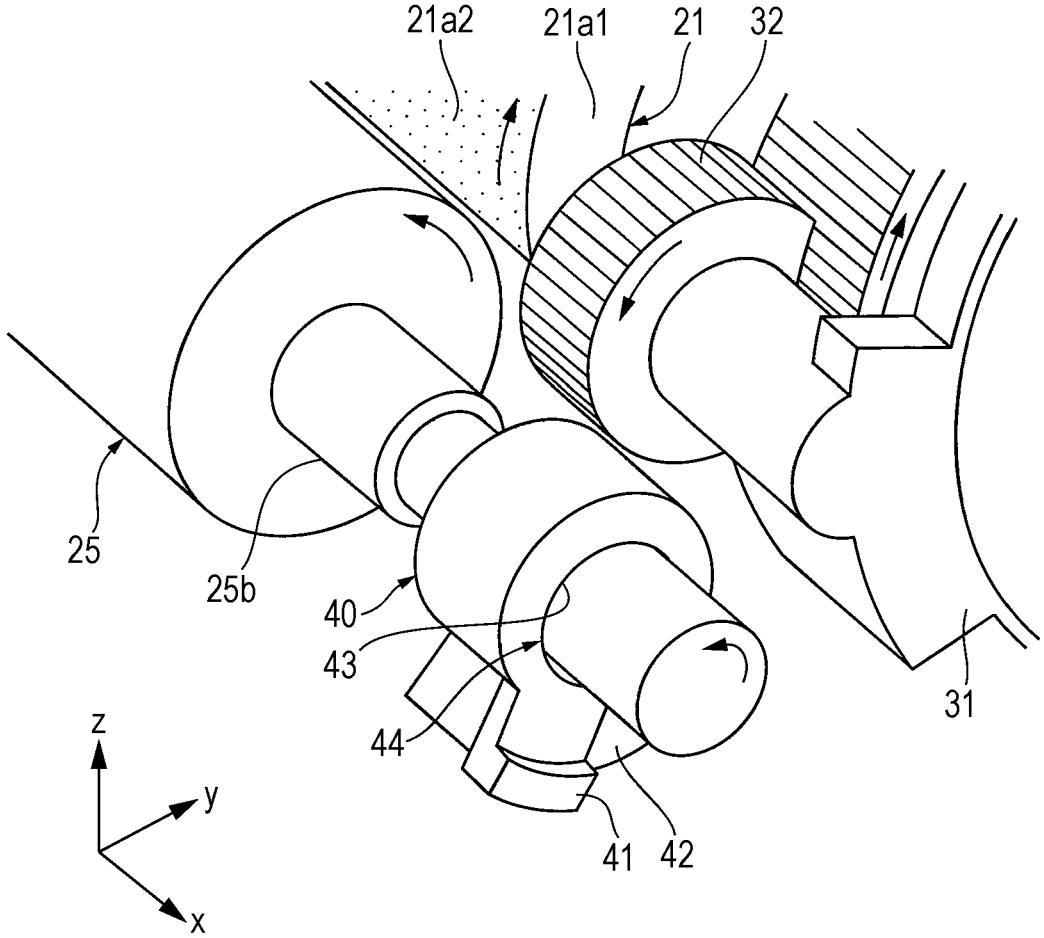
FIG. 7 is a partial perspective view illustrating a state after the gap-maintaining state established by the first gap-maintaining member included in the first retracting mechanism according to the first exemplary embodiment is cancelled.

FIG. 6 is a partial sectional view illustrating a state before the state in which the gap g1 is maintained by the first gap-maintaining member 40 according to the present exemplary embodiment is cancelled, and FIG. 7 is a partial sectional view illustrating a state after the state in which the gap g1 is maintained by the first gap-maintaining member 40 is cancelled.

In FIG. 6, the first gap-maintaining member 40 is retained in the initial position, so that the gap g1 is reliably maintained.

After the state in which the gap g1 is maintained by the first gap-maintaining member 40 according to the present exemplary embodiment is cancelled, as illustrated in FIG. 7, the first gap-maintaining member 40 is positioned such that the first maintaining portion 41 and the first link portion 42 are in a lower region in the −z direction in FIGS. 6 and 7 due to the gravity.

When the state in which the gap g1 is maintained by the first gap-maintaining member 40 is cancelled, the transfer roller 25 comes into contact with the photoconductor 21 at the end at which the first gap-maintaining member 40 is provided, and starts to rotate in response to the rotation of the photoconductor 21. At this time, the first maintaining portion 41 and the first link portion 42 are located in a lower region of the first gap-maintaining member 40, and remain in that region. As a result, the first gap-maintaining member 40 freely rotates around the shaft portion 25*b* of the transfer roller 25 in substantially the same orientation, and is prevented from coming into contact with, for example, the intermediate gear 32.

Operation of Second Gap-Maintaining Member

Figure 8:
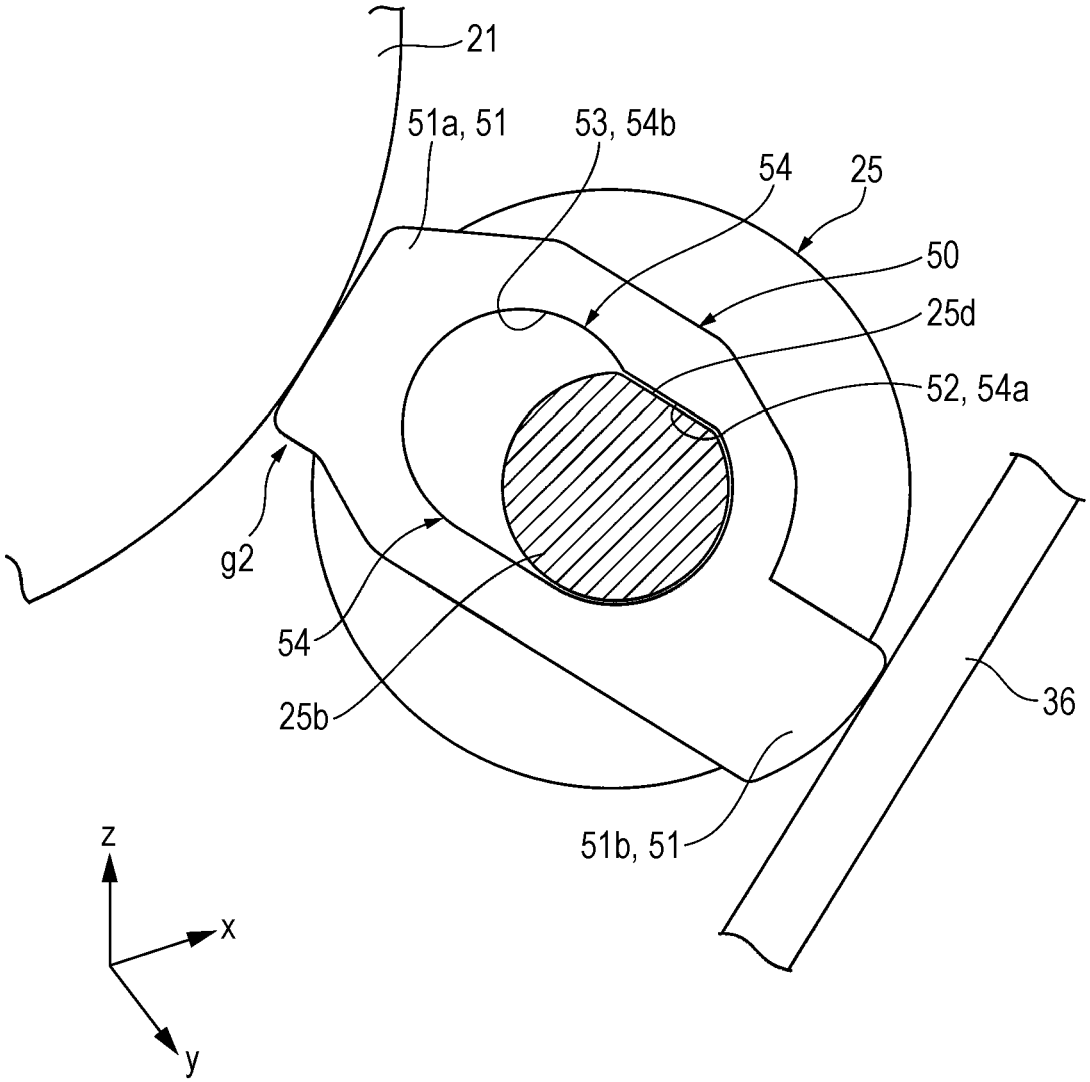
FIG. 8 is a perspective view illustrating the initial position of a second gap-maintaining member, included in a second retracting mechanism, in the image forming apparatus according to the first exemplary embodiment.
Figure 9:
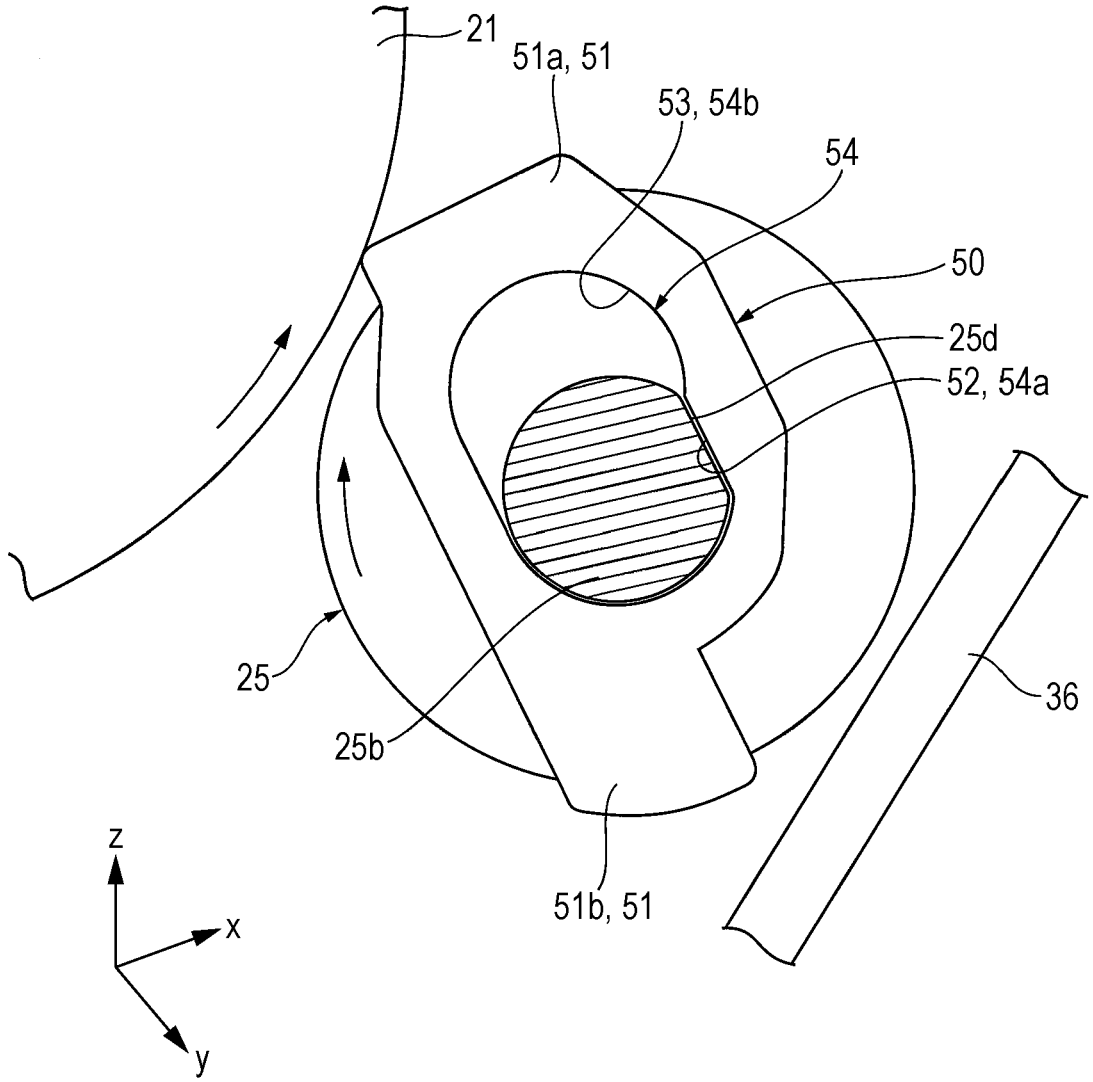
FIG. 9 is a perspective view illustrating how the second gap-maintaining member included in the second retracting mechanism is moved in the first exemplary embodiment.
Figure 10:
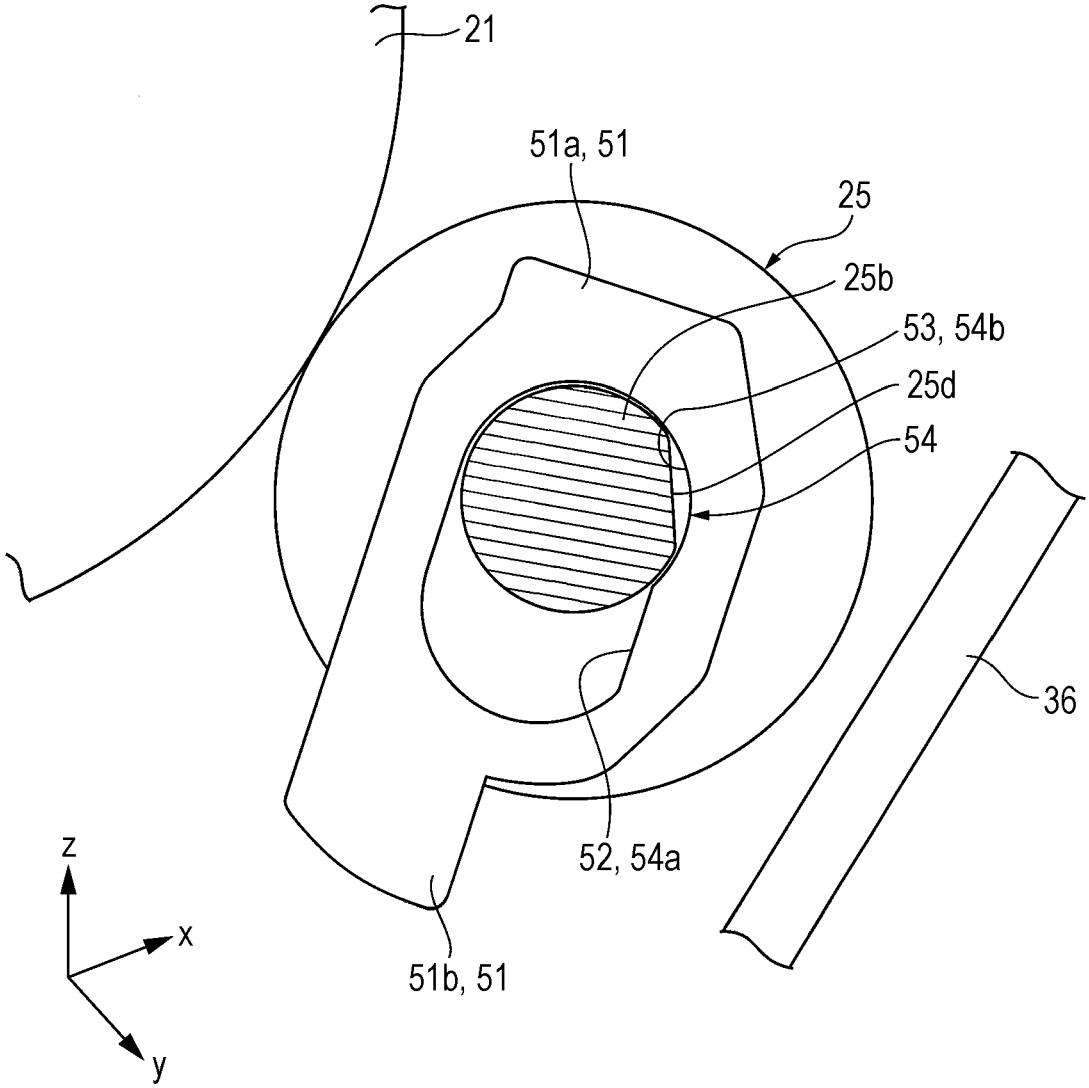
FIG. 10 is a perspective view illustrating the manner in which a gap-maintaining state established by the second gap-maintaining member included in the second retracting mechanism according to the first exemplary embodiment is cancelled.

FIGS. 8 to 10 are perspective views illustrating the movement of the second gap-maintaining member 50 according to the present exemplary embodiment.

When the state in which the gap g1 is maintained by the first gap-maintaining member 40 is cancelled, portions of the photoconductor 21 and the transfer roller 25 come into contact with each other, so that the transfer roller 25 starts to rotate in response to the rotation of the photoconductor 21. FIG. 8 illustrates the position of the second gap-maintaining member 50 at the time when the transfer roller 25 starts to rotate. The two second maintaining portions 51 (51*a* and 51*b* in the present exemplary embodiment) of the second gap-maintaining member 50 are in contact with the photoconductor 21 and the bracket 36.

At this time, the shaft portion 25*b* of the transfer roller 25 is disposed in a portion of the hole 54 in the second gap-maintaining member 50, the portion having a shape corresponding to the shape of the shaft portion 25*b* including the D-cut portion 25*d*. In other words, the shaft portion 25*b* is at the second link portion 52 of the second gap-maintaining member 50. Therefore, the second gap-maintaining member 50 is rotated in response to the rotation of the transfer roller 25. FIG. 9 illustrates the state in which the second gap-maintaining member 50 has rotated so that one second maintaining portion 51 (51*b* in the present exemplary embodiment) is separated from the bracket 36. When the second gap-maintaining member 50 is rotated in response to the rotation of the transfer roller 25, the two second maintaining portions 51 (51*a* and 51*b*) gradually rotate. In the present exemplary embodiment, the second maintaining portion 51 that is in contact with the bracket 36 (51*b* in the present exemplary embodiment) becomes separated from the bracket 36 first.

When one second maintaining portion 51 (51*b* in the present exemplary embodiment) is separated from the bracket 36, as illustrated in FIG. 10, the second maintaining portion 51 (51*b* in the present exemplary embodiment) of the second gap-maintaining member 50 is pulled downward in the −z direction by gravity. Accordingly, the shaft portion 25*b* of the transfer roller 25 moves to the second cancelling portion 53, that is, to the hole portion 54*b* of the hole 54 in the second gap-maintaining member 50, the hole portion 54*b* having a diameter greater than that of the shaft portion 25*b*. As a result, the state in which the gap g2 is maintained by the second gap-maintaining member 50 is cancelled, and the photoconductor 21 and the transfer roller 25 come into contact with each other over the entire region thereof. The second gap-maintaining member 50 freely rotates around the shaft portion 25*b* of the transfer roller 25 in such a manner that the second maintaining portion 51 (51*b* in the present exemplary embodiment) is in a lower region.

Thus, in the present exemplary embodiment, when the operation of the image forming apparatus 10 is started, the photoconductor 21 is rotated so that the state in which the gap g1 is maintained by the first gap-maintaining member 40 is cancelled. When the gap-maintaining state of the first gap-maintaining member 40 is cancelled, a portion of the peripheral surface of the transfer roller 25 comes into contact with the photoconductor 21. Accordingly, the transfer roller 25 is rotated. When the transfer roller 25 is rotated by a predetermined amount, the state in which the gap g2 is maintained by the second gap-maintaining member 50 is cancelled, and the transfer roller 25 comes into contact with the photoconductor 21 over the entire region thereof. The photoconductor 21 and the transfer roller 25 are brought into contact with each other without any manual operation.

After the state in which the gap g1 is maintained by the first gap-maintaining member 40 and the state in which the gap g2 is maintained by the second gap-maintaining member 50 are cancelled, both the first gap-maintaining member 40 and the second gap-maintaining member 50 freely rotate around the shaft portion 25*b* of the transfer roller 25, and are prevented from falling in the apparatus or influencing the image forming operation.

In the present exemplary embodiment, the shaft portion 25*b* of the transfer roller 25 includes the D-cut portion 25*d* at the end opposite to the end adjacent to the drive mechanism of the photoconductor 21. However, a polygonal portion, for example, may be provided instead of the D-cut portion 25*d*. There is no particular limitation as long as the second link portion 52 causes the second gap-maintaining member 50 to be rotated in response to the rotation of the shaft portion 25*b* of the transfer roller 25.

In the present exemplary embodiment, the gear teeth of the first link portion 42 of the first gap-maintaining member 40 and the intermediate gear 32 mesh with each other, so that the first gap-maintaining member 40 is rotated. However, the rotating force may instead be transmitted to the first link portion 42 without using the intermediate gear 32.

Although a charging roller is described as the charging device 22 in the present exemplary embodiment, a non-contact charging device, such as a corotron charging device, may instead be used to charge the photoconductor 21. In the case where a charging roller is used as the charging device 22, the first gap-maintaining member 40 and the second gap-maintaining member 50 for the transfer roller 25 according to the present exemplary embodiment may instead be applied to a shaft portion of the charging roller. In such a case, the charging roller is brought into contact with the photoconductor 21 when the operation of the image forming apparatus 10 is started.

Although the image forming apparatus 10 has a structure for monochrome printing in the present exemplary embodiment, the image forming apparatus 10 may instead have a structure for color printing.

In the present exemplary embodiment, the gap g1 is maintained by arranging the first maintaining portion 41 of the first gap-maintaining member 40 and the bracket 31 so as to be in contact with each other, and the gap g2 is maintained by arranging one second maintaining portion 51 (51*a* in the present exemplary embodiment) of the second gap-maintaining member 50 and the photoconductor 21 so as to be in contact with each other. Alternatively, however, the gap g2 may be maintained by arranging one second maintaining portion 51 of the second gap-maintaining member 50 so as to be in contact with, for example, a bracket supported by the apparatus housing 11 instead of the photoconductor 21. Also, the gap g1 may be maintained by arranging the first maintaining portion 41 of the first gap-maintaining member 40 so as to be in contact with the photoconductor 21.

First Modification

Figure 11A:
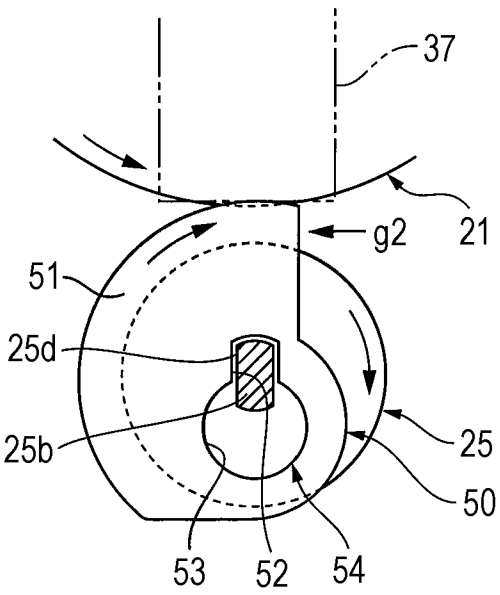
FIGS. 11A to 11C illustrate how a second gap-maintaining member included in a second retracting mechanism according to a first modification is moved.
Figure 11B:
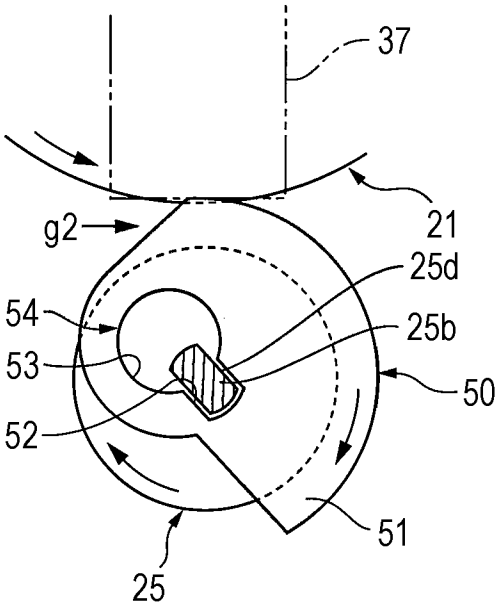
Figure 11C:
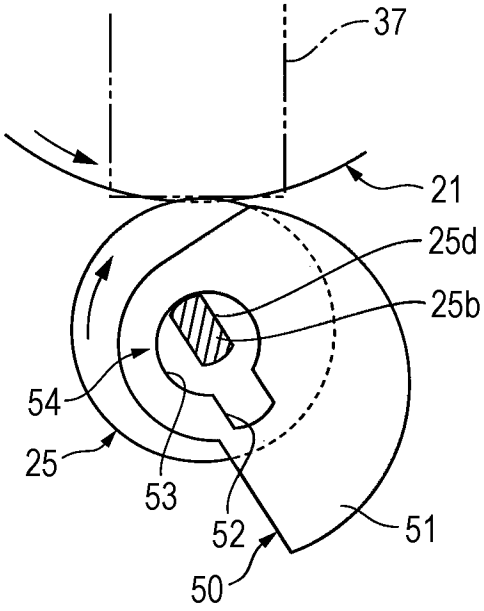

FIGS. 11A to 11C are diagrams illustrating the operation of a second gap-maintaining member 50 having a shape different from that of the second gap-maintaining member 50 according to the first exemplary embodiment. Referring to FIGS. 11A to 11C, in this modification, the second gap-maintaining member 50 includes a second maintaining portion 51 having a shape different from that in the first exemplary embodiment.

In this modification, a transfer roller 25 includes a shaft portion 25*b* having two D-cut portions 25*d*, and the second gap-maintaining member 50 includes a second link portion 52 having a shape corresponding to the shape of the shaft portion 25*b* of the transfer roller 25. The second maintaining portion 51 substantially has the shape of a sector whose center is at the shaft portion 25*b* of the transfer roller 25. The arc-shaped portion of the second maintaining portion 51 is in contact with a bracket 37 supported by the apparatus housing 11.

The operation of this structure will be described.

FIG. 11A illustrates the state in which the operation of the image forming apparatus 10 is started so that the state in which the gap g1 is maintained by the first gap-maintaining member 40 (not shown) is cancelled, and in which the photoconductor 21 and a portion of the peripheral surface of the transfer roller 25 are brought into contact with each other so that the transfer roller 25 starts to rotate. Since the shaft portion 25*b* of the transfer roller 25 is at the second link portion 52 of the second gap-maintaining member 50, the second gap-maintaining member 50 starts to rotate in response to the rotation of the transfer roller 25.

When the second gap-maintaining member 50 starts to rotate, the state in which the second maintaining portion 51 and the bracket 37 are in contact with each other is maintained. When the second gap-maintaining member 50 is further rotated and reaches the position illustrated in FIG. 11B, the shaft portion 25*b* of the transfer roller 25 moves from the second link portion 52 toward a second cancelling portion 53 in a hole 54 formed in the second gap-maintaining member 50. In other words, the second gap-maintaining member 50 moves downward due to its own weight. Accordingly, the transfer roller 25 moves toward the photoconductor 21, and the state in which the gap g2 is maintained by the second gap-maintaining member 50 is cancelled, so that the photoconductor 21 and the transfer roller 25 come into contact with each other over the entire region thereof.

In this modification, the gap g2 is maintained by arranging the second maintaining portion 51 and the bracket 37 so as to be in contact with each other. However, the second maintaining portion 51 may instead be arranged so as to be in contact with the photoconductor 21. In addition, the state in which the gap g2 is maintained by the second gap-maintaining member 50 is cancelled by the second cancelling portion 53 when the second gap-maintaining member 50 is rotated by about 120°. However, the amount of rotation of the second gap-maintaining member 50 is not limited.

Second Modification

Figure 12A:
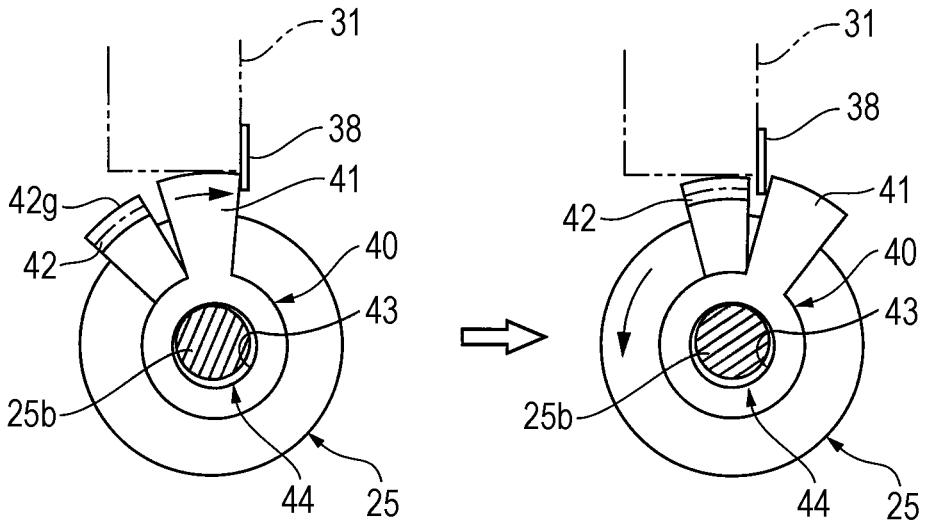
FIGS. 12A and 12B illustrate how first and second gap-maintaining members included in first and second retracting mechanisms according to a second modification are moved.
Figure 12B:
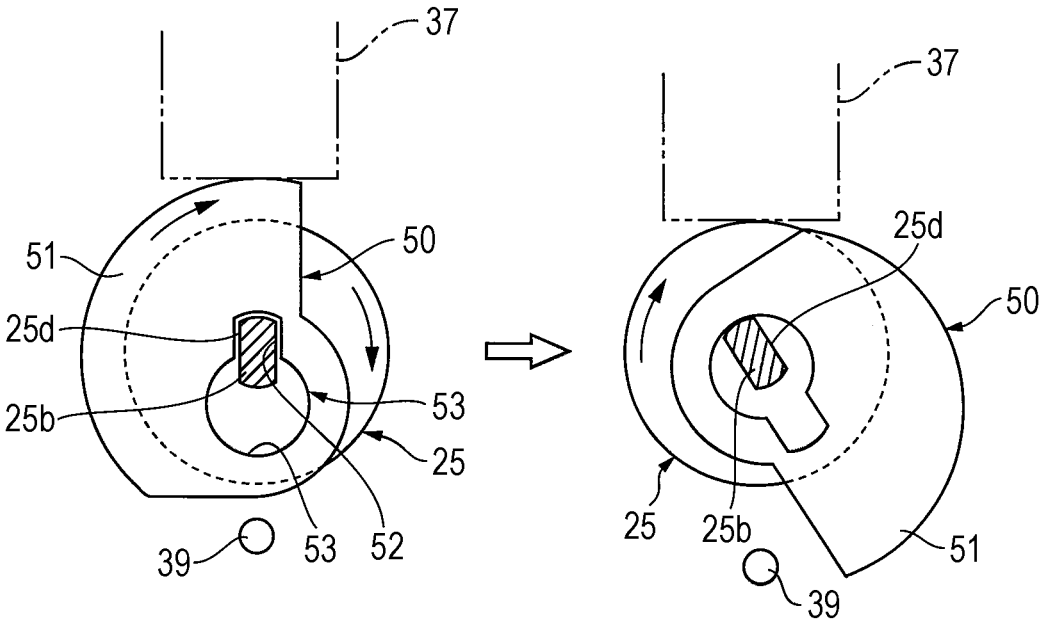

FIGS. 12A and 12B illustrate a modification in which the first gap-maintaining member 40 and the second gap-maintaining member 50 are retained in a stable position while they freely rotate around the shaft portion 25*b* of the transfer roller 25. FIG. 12A illustrates the movement of the first gap-maintaining member 40, and FIG. 12B illustrates the movement of the second gap-maintaining member 50.

Referring to FIG. 12A, a flexible sheet member 38, for example, is disposed on an end portion of the bracket 31 in a region through which the first maintaining portion 41 passes. When the first gap-maintaining member 40 starts to rotate and the first maintaining portion 41 passes the sheet member 38, the state in which the gap g1 is maintained by the first gap-maintaining member 40 is cancelled, and the photoconductor 21 (not shown) and a portion of the peripheral surface of the transfer roller 25 come into contact with each other, so that the transfer roller 25 is rotated. In this modification, the direction in which the first gap-maintaining member 40 is rotated until the state in which the gap g1 is maintained by the first gap-maintaining member 40 is cancelled is opposite to the direction in which the transfer roller 25 rotates after coming into contact with the photoconductor 21. Therefore, due to the rotation of the transfer roller 25, the first gap-maintaining member 40 receives an inertial force in the direction in which the transfer roller 25 rotates. However, in this modification, since the sheet member 38 is provided, even if the first gap-maintaining member 40 is rotated in response to the rotation of the transfer roller 25, the rotation is stopped by the flexible sheet member 38, and the first gap-maintaining member 40 is freely rotated in a stable position.

Referring to FIG. 12B, a rubber stopper 39, for example, is provided below the second gap-maintaining member 50. When the transfer roller 25 starts to rotate, the second gap-maintaining member 50 also rotates. In this state, the second maintaining portion 51 of the second gap-maintaining member 50 is continuously in contact with the bracket 37. After that, when the second gap-maintaining member 50 is rotated by a predetermined amount, the second gap-maintaining member 50 moves downward, and then freely rotates around the shaft portion 25*b* of the transfer roller 25. However, the rotation of the second gap-maintaining member 50 is stopped at the position where the second maintaining portion 51 of the second gap-maintaining member 50 comes into contact with the stopper 39. Even if the second gap-maintaining member 50 is rotated in response to the rotation of the transfer roller 25, the rotation of the second gap-maintaining member 50 is restricted by the stopper 39, and the second gap-maintaining member 50 freely rotates in a stable position.

In this modification, the flexible sheet member 38 is provided on the bracket 31 at the end adjacent to the first gap-maintaining member 40. However, in the case where the direction in which the first link portion 42 of the first gap-maintaining member 40 is rotated to cancel the state in which the gap g1 is maintained by the first gap-maintaining member 40 is the same as the direction in which the transfer roller 25 is rotated, a stopper similar to the stopper 39 provided for the second gap-maintaining member 50 may instead be provided. In such a case, for example, the first link portion 42 of the first gap-maintaining member 40 may be brought into direct contact with the photoconductor gear 21*c* without using the intermediate gear 32, or an additional intermediate gear may be provided.

Second Exemplary Embodiment

Figure 13:
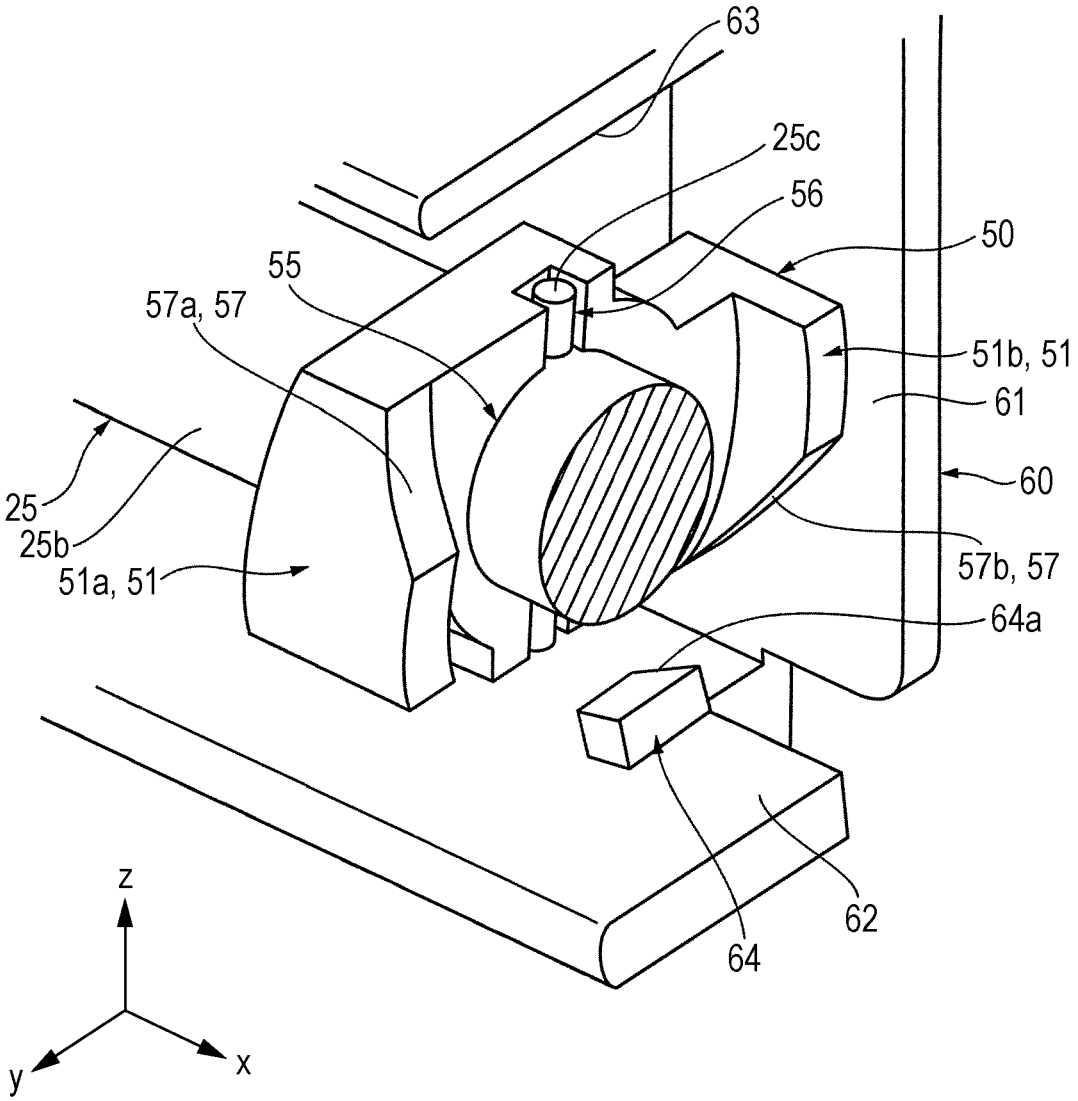
FIG. 13 is a perspective view illustrating the initial position of a second gap-maintaining member included in a second retracting mechanism in an image forming apparatus according to a second exemplary embodiment.
Figure 14:
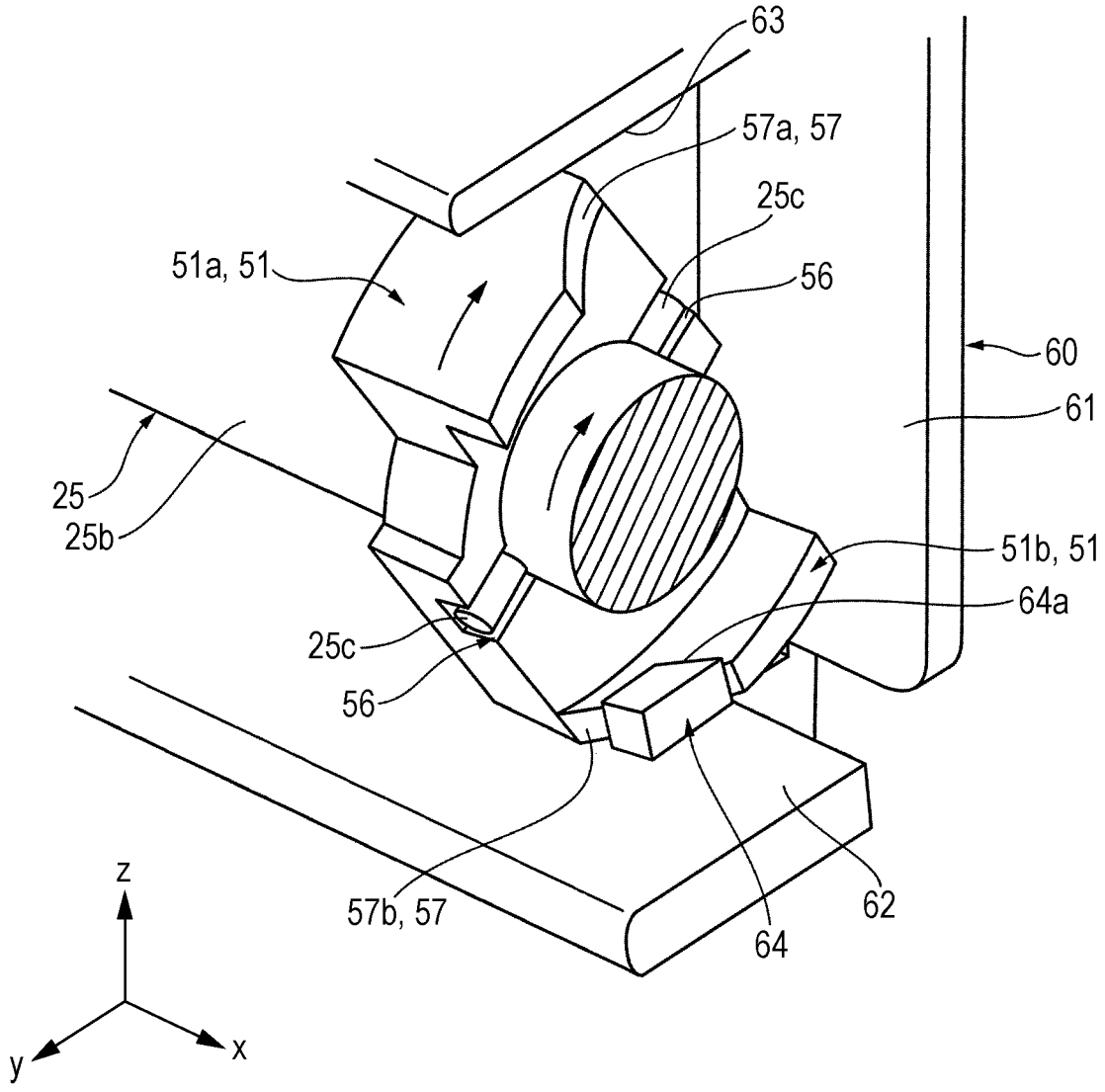
FIG. 14 is a perspective view illustrating how the second gap-maintaining member included in the second retracting mechanism is moved in the second exemplary embodiment.
Figure 15:
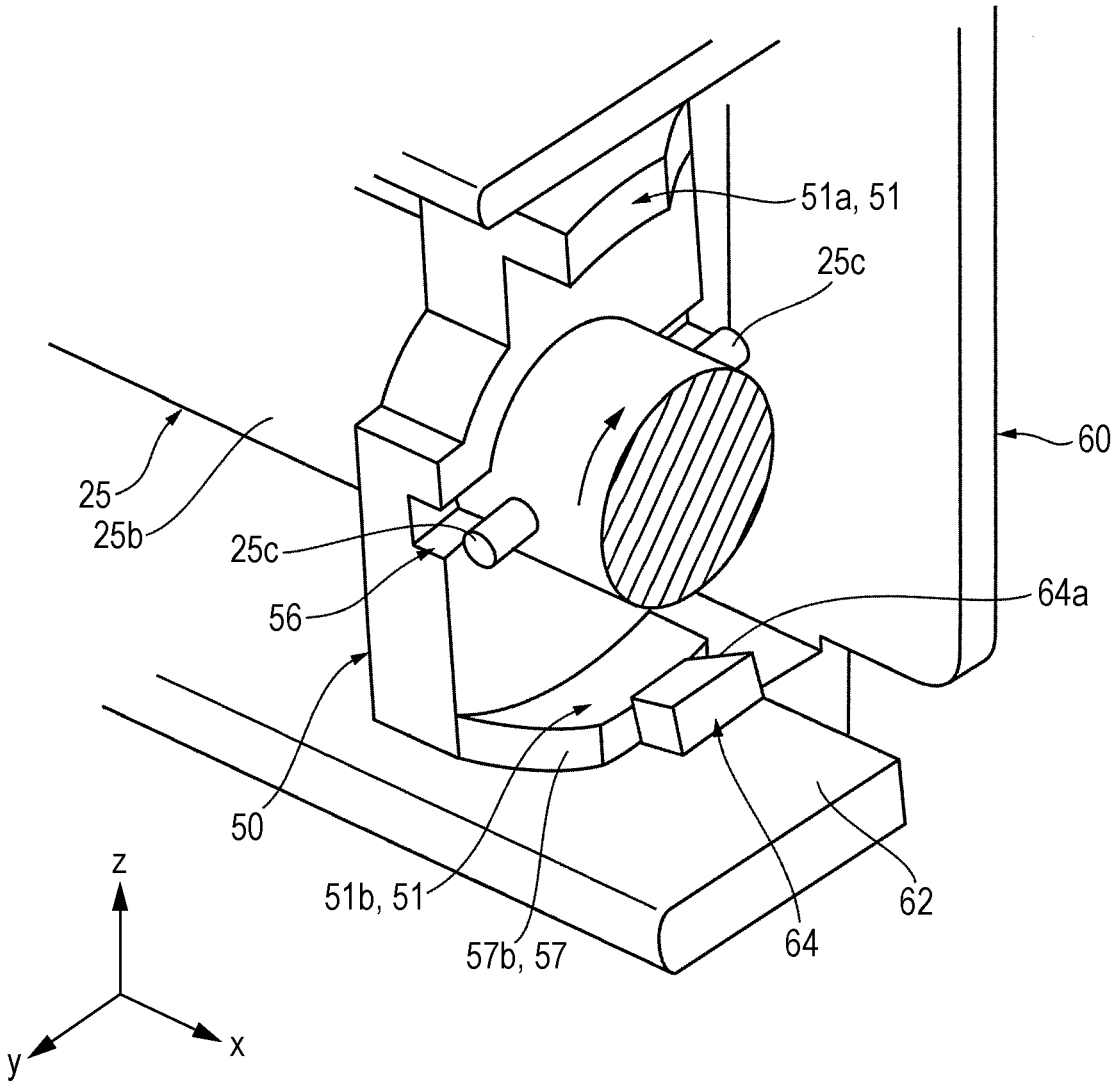
FIG. 15 is a perspective view illustrating the manner in which a gap-maintaining state established by the second gap-maintaining member included in the second retracting mechanism according to the second exemplary embodiment is cancelled.

FIGS. 13 to 15 illustrate a portion of a retracting system 100 included in an image forming apparatus 10 according to a second exemplary embodiment, and are perspective views illustrating the relationship between a second gap-maintaining member 50 and a shaft portion 25*b* of a transfer roller 25.

In the present exemplary embodiment, the structures of the second gap-maintaining member 50 and the shaft portion 25*b* of the transfer roller 25 differ from those of the first exemplary embodiment. The structures of the image forming apparatus 10 and a first gap-maintaining member 40 are substantially the same as those in the first exemplary embodiment, and detailed descriptions thereof are thus omitted.

In the present exemplary embodiment, FIG. 13 illustrates a state before the operation of the image forming apparatus 10 is started and before the state in which the gap g1 is maintained by the first gap-maintaining member 40 is cancelled. FIG. 14 illustrates a state after the rotation of the transfer roller 25 is started. FIG. 15 illustrates a state after the state in which the gap g2 is maintained by the second gap-maintaining member 50 is cancelled.

The transfer roller 25 according to the present exemplary embodiment includes a shaft portion 25*b* provided with a pin 25*c* that extends through the shaft portion 25*b* and that projects from the shaft portion 25*b* at both ends thereof.

The second gap-maintaining member 50 has a hole 55 having a diameter that is slightly greater than the diameter of the shaft portion 25*b* of the transfer roller 25. The shaft portion 25*b* of the transfer roller 25 extends through the hole 55. The second gap-maintaining member 50 also has two recesses 56 that receive the pin 25*c* provided on the shaft portion 25*b*. Two second maintaining portions 51 (51*a* and 51*b* in the present exemplary embodiment) are provided so as to extend in a direction substantially perpendicular to the line that connects the recesses 56. The outer surfaces of the second maintaining portions 51 (51*a* and 51*b*) extend along a cylindrical surface having the shaft portion 25*b* at the center. One second maintaining portion 51 (51*a* in the present exemplary embodiment) has an oblique surface 57*a* that extends at an angle with respect to the x direction along the rotational direction of the shaft portion 25*b*. The other second maintaining portion 51 (51*b* in the present exemplary embodiment) also has an oblique surface 57*b* that extends at an angle with respect to the x direction along the rotational direction of the shaft portion 25*b*.

A frame 60, which is supported by the apparatus housing 11 (see FIG. 3), is provided so as to surround the end of the transfer roller 25 that is adjacent to the second gap-maintaining member 50 in three directions. The frame 60 includes a z surface 61 that extends substantially in the z direction, and upper and lower y surfaces 62 and 63 that extend substantially in the y direction. Among the y surfaces 62 and 63, the lower y surface 62 has a projection 64 having an oblique surface 64*a* that extends at an angle with respect to the y direction along the rotational direction of the shaft portion 25*b*. The upper y surface 63 of the frame 60 also has a projection (not shown) having substantially the same structure as that of the projection 64.

The operation of the second gap-maintaining member 50 according to the second exemplary embodiment will be described.

As illustrated in FIG. 13, when the transfer roller 25 is not rotated, the two second maintaining portions 51 (51*a* and 51*b*) of the second gap-maintaining member 50 are in contact with the photoconductor 21 (not shown) and the z surface 61 of the frame 60. The pin 25*c* provided on the shaft portion 25*b* of the transfer roller 25 is disposed in the recesses 56 formed in the second gap-maintaining member 50.

When the state in which the gap g1 is maintained by the first gap-maintaining member 40 (not shown) is cancelled and the transfer roller 25 starts to rotate, as illustrated in FIG. 14, the second gap-maintaining member 50 rotates together with the transfer roller 25. Accordingly, the oblique surfaces 57 (57*a* and 57*b*) of the second maintaining portions 51 (51*a* and 51*b*) respectively come into contact with the projection (not shown) on the y surface 63 and the projection 64 on the y surface 62. At this time, the oblique surface 57 (57*b* in the present exemplary embodiment) of one second maintaining portion 51 (51*b* in the present exemplary embodiment) slides along the oblique surface 64*a* of the projection 64, and the other second maintaining portion 51 (51*a* in the present exemplary embodiment) is operated in a similar manner.

Then, as illustrated in FIG. 15, as the oblique surface 57*b* of one second maintaining portion 51 (51*b*) slides along the oblique surface 64*a* of the projection 64, the second gap-maintaining member 50 is pushed in the −x direction along the shaft portion 25*b* of the transfer roller 25. As a result, the pin 25*c* on the shaft portion 25*b* is moved out of the two recesses 56 in the second gap-maintaining member 50. A stopper (not shown) is provided to prevent the second gap-maintaining member 50 from being rotated. The other second maintaining portion 51 (51*a* in the present exemplary embodiment) is operated in a similar manner.

Thus, the pin 25*c* provided on the shaft portion 25*b* is removed from the recesses 56 in the second gap-maintaining member 50, so that the second gap-maintaining member 50 is prevented from being rotated in response to the rotation of the transfer roller 25. Thus, the second gap-maintaining member 50 is freely rotated in a stable position.

As described above, in the present exemplary embodiment, the recesses 56 formed in the second gap-maintaining member 50 correspond to the second link portion, and the hole 55, which has a diameter greater than that of the shaft portion 25*b* of the transfer roller 25, corresponds to the second cancelling portion.

Here, the pin 25*c* projects from the shaft portion 25*b* at both ends thereof. However, the pin 25*c* may instead be arranged to project from the shaft portion 25*b* only at one end thereof, as long as the second gap-maintaining member 50 is rotated in response to the rotation of the transfer roller 25.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a toner image and that is rotatable;

a drive mechanism that is provided at one end of the image carrier and that drives the image carrier so as to rotate the image carrier;

a rotating member that comes into contact with the image carrier so as to be rotated by the image carrier;

an urging member that urges the rotating member in a direction toward the image carrier; and a retracting system that retains the rotating member in a retracted state in which the rotating member is positioned so as not to be in contact with the image carrier, and cancels the retracted state of the rotating member so that a peripheral surface of the rotating member comes into contact with the image carrier when the drive mechanism starts to drive the image carrier, wherein the retracting system includes a first retracting mechanism including a first gap-maintaining member that is provided on a shaft portion of the rotating member at an end adjacent to the drive mechanism and that maintains a gap between the image carrier and the peripheral surface of the rotating member, the first retracting mechanism cancelling the retracted state of the rotating member at one end in an axial direction by moving the first gap-maintaining member in response to an operation of the drive mechanism and cancelling a gap-maintaining state established by the first gap-maintaining member, and a second retracting mechanism including a second gap-maintaining member that is provided on the shaft portion of the rotating member at the other end and that maintains a gap between the image carrier and the peripheral surface of the rotating member, the second retracting mechanism cancelling the retracted state of the rotating member at the other end in the axial direction by enabling the rotating member to be rotated by the image carrier after the retracted state of the rotating member is cancelled by the first retracting mechanism and after the peripheral surface of the rotating member comes into contact with the image carrier, moving the second gap-maintaining member in response to a rotation of the rotating member, and cancelling a gap-maintaining state established by the second gap-maintaining member, wherein when the operation of the drive mechanism is started, first, the first gap-maintaining member is moved to cancel the retracted state of the rotating member at the one end while maintaining the retracted state of the rotating member at the other end, and after that, the second gap-maintaining member is moved to cancel the retracted state at the other end.

2. The image forming apparatus according to claim 1, wherein the first gap-maintaining member includes a first maintaining portion provided on the shaft portion of the rotating member at the end adjacent to the drive mechanism such that the first maintaining portion is freely rotatable around the shaft portion, the first maintaining portion resisting an urging force applied by the urging member so as to maintain the gap, a first link portion that is operatively linked to the drive mechanism so that the first maintaining portion is rotated by a driving force applied by the drive mechanism when an operation of the image forming apparatus is started, and a first cancelling portion that cancels a gap-maintaining state established by the first maintaining portion when the first maintaining portion is rotated by a predetermined amount due to the first link portion, and wherein the second gap-maintaining member includes a second maintaining portion provided on the shaft portion of the rotating member at an end opposite to the end adjacent to the drive mechanism such that the second maintaining portion is freely rotatable around the shaft portion, the second maintaining portion resisting the urging force applied by the urging member so as to maintain the gap, a second link portion that is operatively linked to the rotating member so that the second maintaining portion is rotated after the gap-maintaining state established by the first maintaining portion is cancelled by the first cancelling portion, and a second cancelling portion that cancels a gap-maintaining state established by the second maintaining portion when the second maintaining portion is rotated by a predetermined amount due to the second link portion.

3. The image forming apparatus according to claim 2, wherein the first gap-maintaining member freely rotates around the shaft portion of the rotating member after the gap-maintaining state established by the first maintaining portion is cancelled by the first cancelling portion, and wherein the second gap-maintaining member freely rotates around the shaft portion of the rotating member after the gap-maintaining state established by the second maintaining portion is cancelled by the second cancelling portion.

4. The image forming apparatus according to claim 2, wherein the drive mechanism includes a gear that rotates when the image carrier is rotated, and wherein the first link portion includes a gear-shaped portion that has a predetermined number of teeth and that meshes with the gear.

5. The image forming apparatus according to claim 2, wherein the first gap-maintaining member further includes a first restraining portion that restrains the first gap-maintaining member from rotating in the same direction as a direction in which the rotating member rotates after the gap-maintaining state established by the first maintaining portion is cancelled by the first cancelling portion, and wherein the second gap-maintaining member further includes a second restraining portion that restrains the second gap-maintaining member from rotating in the same direction as the direction in which the rotating member rotates after the gap-maintaining state established by the second maintaining portion is cancelled by the second cancelling portion.

6. The image forming apparatus according to claim 2, wherein the rotating member is a transfer member that is capable of coming into contact with the image carrier and that transfers the toner image carried by the image carrier onto a recording medium.

7. The image forming apparatus according to claim 2, wherein the rotating member is a charging member that is capable of coming into contact with the image carrier and that charges the image carrier to a predetermined charging potential.

8. The image forming apparatus according to claim 1, wherein the rotating member is a transfer member that is capable of coming into contact with the image carrier and that transfers the toner image carried by the image carrier onto a recording medium.

9. The image forming apparatus according to claim 1, wherein the rotating member is a charging member that is capable of coming into contact with the image carrier and that charges the image carrier to a predetermined charging potential.

10. The image forming apparatus according to claim 1, wherein the second gap-maintaining member has a hole that comprises a hole portion having a shape that corresponds to a shape of the shaft portion of the rotating member, and a hole portion that has a diameter greater than a diameter of the shaft portion of the rotating member that is connected to the hole portion having the shape that corresponds to the shape of the shaft portion of the rotating member.

11. The image forming apparatus according to claim 1, wherein the shaft portion comprises a D-cut portion.

* * * * *